US012800189B2

(12) United States Patent
Uno et al.

(10) Patent No.: US 12,800,189 B2
(45) Date of Patent: Nov. 17, 2026

(54) BATHTUB DEVICE

(71) Applicant: TOTO LTD., Fukuoka (JP)

(72) Inventors: Ryoko Uno, Fukuoka (JP); Hiroshi Tsuboi, Fukuoka (JP); Yu Ichikawa, Fukuoka (JP); Masayoshi Enoki, Fukuoka (JP); Kei Watanabe, Fukuoka (JP); Kensuke Azuma, Fukuoka (JP); Mao Jinde, Fukuoka (JP); Yuwa Ishii, Fukuoka (JP)

(73) Assignee: Toto Ltd., Fukuoka (JP)

( * ) Notice: Subject to any disclaimer, the term of this patent is extended or adjusted under 35 U.S.C. 154(b) by 261 days.

(21) Appl. No.: 18/734,539

(22) Filed: Jun. 5, 2024

(65) Prior Publication Data

US 2024/0318866 A1 Sep. 26, 2024

Related U.S. Application Data

(63) Continuation of application No. PCT/JP2023/006140, filed on Feb. 21, 2023.

(30) Foreign Application Priority Data

Feb. 25, 2022 (JP) ..... 2022-027447
Feb. 25, 2022 (JP) ..... 2022-027448
(Continued)

(51) Int. Cl.
*F24H 1/54* (2022.01)

(52) U.S. Cl.
CPC ..... *F24H 1/54* (2022.01)

(58) Field of Classification Search
CPC ..... F24H 1/54
(Continued)

(56) References Cited

U.S. PATENT DOCUMENTS

2002/0071535 A1* 6/2002 Da Silva ..... E03C 1/055 379/102.01

FOREIGN PATENT DOCUMENTS

JP 1155812 A 6/1989
JP 200558299 A 3/2005
(Continued)

OTHER PUBLICATIONS

Translation of JP 2019150334 (Year: 2019).*
Chinese Office Action dated Nov. 20, 2025 (English Translation).

*Primary Examiner* — Lauren A Crane
(74) *Attorney, Agent, or Firm* — BakerHostetler

(57) ABSTRACT

The bathtub device of the present invention includes a water discharge part (8) provided on a bathtub main body, a circulation channel (4), a circulation pump (6) provided on the circulation channel, a temperature modification part (7), a sensing unit (22) for detecting a temperature of hot water in the bathtub main body, and a controller (16) for controlling the temperature of hot water, where the controller performs a water discharge temperature adjustment mode in which the temperature of hot water discharged from the water discharge part is reduced to within the predetermined temperature range, when the temperature is higher than an upper limit temperature of a predetermined temperature range, or a water discharge temperature adjustment mode in which the temperature of hot water is increased to within the predetermined temperature range, when the temperature is lower than a lower limit temperature of the predetermined temperature range.

11 Claims, 14 Drawing Sheets

(30) Foreign Application Priority Data

Jan. 13, 2023 (JP) ..... 2023-003550
Jan. 13, 2023 (JP) ..... 2023-003551

(58) Field of Classification Search
USPC ..... 4/541.2
See application file for complete search history.

(56) References Cited

FOREIGN PATENT DOCUMENTS

| | | | | |
|---|---|---|---|---|
| JP | 2006064335 | A | | 3/2006 |
| JP | 2014001913 | A | | 1/2014 |
| JP | 2017156048 | A | | 9/2017 |
| JP | 2018121851 | A | | 8/2018 |
| JP | 2019150334 | A | * | 9/2019 |
| KR | 1020130039284 | A | | 4/2013 |

* cited by examiner

BATHTUB DEVICE

CROSS-REFERENCE TO RELATED APPLICATIONS

This application is a Continuation of International Application No. PCT/JP2023/006140 filed Feb. 21, 2023 designating the U.S., which claims priority to Japanese Application No. 2022-027447 filed on Feb. 25, 2022, Japanese Application No. 2022-027448 filed on Feb. 25, 2022, Japanese Application No. 2023-003550 filed on Jan. 13, 2023, and Japanese Application No. 2023-003551 filed on Jan. 13, 2023, all of which are incorporated herein by reference in their entirety.

TECHNICAL FIELD

The present invention relates to a bathtub device, and more particularly, to a bathtub device for supplying hot water to a bathtub.

BACKGROUND ART

As described in Patent Literature 1, there is known a bathroom system including body temperature determination means for determining whether a body temperature of a bathing person is increased or not. With the bathroom system, in the case where an increase in the body temperature of a bathing person is determined, an operation for lowering the body temperature of the bathing person, such as an operation of blowing air or pouring cold water, is performed so that the bathing person is prevented from becoming dizzy or unwell.

As described in Patent Literature 2, there is known a bathtub device for warming the neck or the back with a heater such that an internal body temperature of a bathing person is kept within a comfortable temperature zone. An aim of the bathtub device is to keep both the internal body temperature and a sensed temperature within respective comfortable temperature zones during long bathing.

CITATION LIST

Patent Literature

Patent Literature 1: Japanese Patent Laid-Open No. 2005-58299

Patent Literature 2: Japanese Patent Laid-Open No. 2018-121851

SUMMARY OF INVENTION

Technical Problem

As described in Patent Literatures 1 and 2, consideration is given to increasing a deep body temperature of a bathing person and increasing a bathing effect by allowing the bathing person to take a relatively long bath, while preventing the bathing person from becoming dizzy during bathing, for example.

However, with a water discharge device of a bathtub water circulation type that allows bathing while circulating and discharging bathtub water from the water discharge device, if a bathing person wants to bathe in hot water at a relatively high temperature, a temperature of hot water that is discharged by the discharge device becomes the same as a temperature of hot water in a bathtub, and thus, the bathing person is rapidly warmed by the bathtub water and discharged water, and the bathing person may become dizzy or may rapidly get a chill due to bathing for a short time. Furthermore, with the water discharge device of a bathtub water circulation type that allows bathing while circulating and discharging bathtub water from the water discharge device, if a bathing person wants to bathe in hot water at a relatively low temperature, the bathing person is possibly not sufficiently warmed even when bathing for a long time.

Accordingly, the present invention has been made to solve the problems described above, and is aimed at providing a bathtub device that lowers a temperature of hot water that is discharged from a water discharge part and that is poured directly onto an upper body of a bathing person to within a predetermined temperature range without adjusting a temperature of hot water in a bathtub main body to within the predetermined temperature range, the bathtub device thereby allowing the bathing person to take a relatively long bath without becoming dizzy. Furthermore, the present invention is aimed at providing a bathtub device that can warm a bathing person by allowing the bathing person to take a bath at a comfortable bathing temperature and by discharging water in such a way that a burden is not placed on a body of the bathing person.

Solution to Problem

To solve the problems described above, the present invention is a bathtub device for discharging hot water into a bathtub, the bathtub device comprising: a bathtub main body for storing hot water; a water intake port part for drawing in hot water in the bathtub main body; a water discharge part provided on the bathtub main body and discharging hot water drawn in from the water intake port part into the bathtub main body; a circulation channel connecting the water intake port part to the water discharge part; a circulation pump provided on the circulation channel and feeding hot water drawn in from the water intake port part through the circulation channel; a temperature modification part for modifying a temperature of hot water discharged from the water discharge part; a sensing unit for detecting a temperature of hot water in the bathtub main body; and a controller for controlling the temperature of hot water discharged from the water discharge part by using the temperature modification part, wherein the controller performs a water discharge temperature adjustment mode in which the temperature of hot water discharged from the water discharge part is reduced to within a predetermined temperature range by controlling the temperature modification part, when the temperature of hot water detected by the sensing unit is higher than an upper limit temperature of the predetermined temperature range, or a water discharge temperature adjustment mode in which the temperature of hot water discharged from the water discharge part is increased to within a predetermined temperature range by controlling the temperature modification part, when the temperature of hot water detected by the sensing unit is lower than a lower limit temperature of the predetermined temperature range.

In an embodiment of the present invention configured in the above manner, in a case where the temperature of hot water in the bathtub main body detected by the sensing unit is higher than the upper limit temperature of the predetermined temperature range, the controller performs the water discharge temperature adjustment mode in which the temperature of hot water to be discharged from the water discharge part toward inside of the bathtub main body is reduced to within the predetermined temperature range by the temperature modification part. Furthermore, in a case where the temperature of hot water in the bathtub main body detected by the sensing unit is lower than the lower limit temperature of the predetermined temperature range, the controller performs the water discharge temperature adjustment mode in which the temperature of hot water to be discharged from the water discharge part toward inside of the bathtub main body is increased to within the predetermined temperature range by the temperature modification part. Accordingly, the temperature of hot water discharged from the water discharge part can be maintained within the predetermined temperature range, and a bathing person can be prevented from being excessively warmed, and also, a state where a bathing person cannot be warmed can be prevented from being continued.

In the present invention, preferably, in the water discharge temperature adjustment mode, the controller circulates hot water drawn in from the water intake port part to discharge hot water from the water discharge part, for a predetermined period of time from start of water discharge and after a lapse of the predetermined period of time, the controller reduces the temperature of hot water discharged from the water discharge part to within the predetermined temperature range by controlling the temperature modification part, or the controller increases the temperature of hot water discharged from the water discharge part to within the predetermined temperature range by controlling the temperature modification part.

In the present invention configured in the above manner, in the water discharge temperature adjustment mode, water discharge is performed, for a predetermined period of time from reception of a command to start control, from the water discharge device toward the inside of the bathtub main body by circulating hot water that is drawn in from the water intake port part, and after a lapse of the predetermined period of time, the temperature of hot water to be discharged from the water discharge part is reduced to within the predetermined temperature range by the temperature modification part. Accordingly, even in a case where a bathing person wants to take a bath with the temperature of hot water in the bathtub main body being at a temperature higher than the upper limit temperature of the predetermined temperature range that is a recommended temperature zone in which a bathing person can be comfortably warmed, for example, the temperature of hot water that is discharged from the water discharge part and poured directly onto the upper body, such as the neck and shoulders, of the bathing person can be reduced to within the predetermined temperature range without adjusting the temperature of hot water in the bathtub main body to within the predetermined temperature range, and thus, the bathing person can be prevented from becoming dizzy, and can be allowed to take a relatively long bath.

Furthermore, in the present invention configured in the above manner, there is included the water discharge temperature adjustment mode in which water discharge is performed, for a predetermined period of time from reception of a command to start control, from the water discharge part toward the inside of the bathtub main body by circulating hot water that is drawn in from the water intake port part, and after a lapse of the predetermined period of time, the temperature of hot water to be discharged from the water discharge part is increased to within the predetermined temperature range by the temperature modification part. Accordingly, in the case where the bathing person wants to take a bath at a lower temperature than the lower limit temperature of the predetermined temperature range, for example, a bathing temperature that is comfortable to the bathing person can be maintained by keeping the temperature of hot water in the bathtub main body at a relatively low temperature while increasing the temperature of hot water that is discharged from the water discharge part and poured directly onto the upper body, such as the neck and the shoulders, of the bathing person to within the predetermined temperature range, and the bathing person can thereby be partially warmed. The bathing person can thereby take a bath at a comfortable bathing temperature while being warmed by water discharge that does not place much burden on the body of the bathing person.

Moreover, for a predetermined period of time from start of control in the water discharge temperature adjustment mode, water discharge is performed from the water discharge part by circulating hot water that is drawn in from the water intake port part, and a drastic temperature change is prevented from being applied to the naked bathing person taking a bath, and the bathing person is allowed to take a bath without much burden being placed on the body of the bathing person.

In the present invention, preferably, the temperature modification part includes a reservoir part for storing hot water at a desired temperature, the controller acquires the temperature of hot water in the bathtub main body by the sensing unit in a state where hot water is not discharged by the water discharge part, and causes hot water at a lower temperature than the upper limit temperature to be stored in the reservoir part when the acquired temperature is higher than the upper limit temperature, or causes hot water at a higher temperature than the lower limit temperature to be stored in the reservoir part when the acquired temperature is lower than the lower limit temperature, and wherein the controller conducts the water discharge temperature adjustment mode by mixing hot water stored in the reservoir part with hot water discharged from the water discharge part, when an instruction signal for starting water discharge is received.

In the present invention configured in the above manner, the temperature of hot water in the bathtub main body is acquired in a state where water discharge from the water discharge part is not performed, and in a case where the temperature is higher than the upper limit temperature, hot water at a lower temperature than the upper limit temperature is stored in the reservoir part. Accordingly, when the controller receives an instruction signal to start water discharge, hot water, in the reservoir part, at a lower temperature than the upper limit temperature can immediately be mixed in hot water that is to be discharged from the water discharge part, and the temperature of hot water to be discharged from the water discharge part can be quickly reduced. Furthermore, when the temperature of hot water in the bathtub main body is acquired and the temperature is lower than the lower limit temperature, hot water at a higher temperature than the lower limit temperature is stored in the reservoir part. Accordingly, when the controller receives an instruction signal to start water discharge, hot water, in the reservoir part, at a higher temperature than the lower limit temperature can immediately be mixed in hot water that is to be discharged from the water discharge part, and the temperature of hot water to be discharged from the water discharge part can be quickly increased.

In the present invention, preferably, the temperature modification part includes a supply channel for mixing hot water at a desired temperature in the circulation channel, the controller acquires the temperature of hot water in the bathtub main body by the sensing unit in a state where hot water is not discharged by the water discharge part, and causes hot water at a lower temperature than the upper limit temperature to flow into the supply channel when the acquired temperature is higher than the upper limit temperature, and causes hot water at a higher temperature than the lower limit temperature to flow into the supply channel when the acquired temperature is lower than the lower limit temperature, and wherein the controller conducts the water discharge temperature adjustment mode by mixing hot water inside the supply channel with hot water discharged from the water discharge part, when an instruction signal for starting water discharge is received.

In the present invention configured in the above manner, the temperature of hot water in the bathtub main body is acquired in a state where water discharge from the water discharge part is not performed, and in a case where the temperature is higher than the upper limit temperature, hot water at a lower temperature than the upper limit temperature is caused to flow into the supply channel. Accordingly, when an instruction signal to start water discharge is received by the controller, hot water, in the supply channel, at a lower temperature than the upper limit temperature can be immediately mixed with hot water that is to be discharged from the water discharge part, and the temperature of hot water to be discharged from the water discharge part can be quickly reduced. Furthermore, when the temperature of hot water in the bathtub main body is acquired and the temperature is lower than the lower limit temperature, hot water at a higher temperature than the lower limit temperature is caused to flow into the supply channel. Accordingly, when an instruction signal to start water discharge is received by the controller, hot water, in the supply channel, at a higher temperature than the upper limit temperature can be immediately mixed with hot water that is to be discharged from the water discharge part, and the temperature of hot water to be discharged from the water discharge part can be quickly increased.

In the present invention, preferably, in the water discharge temperature adjustment mode, the controller reduces or increases the temperature of hot water discharged from the water discharge part, by controlling the temperature modification part, over a plurality of stages from the temperature of hot water in the bathtub main body to a temperature within the predetermined temperature range.

In an embodiment of the present invention configured in the above manner, in the water discharge temperature adjustment mode, the controller reduces or increases, by the temperature modification part, over a plurality of stages, the temperature of hot water to be discharged from the water discharge part from the temperature of hot water in the bathtub main body to a target temperature within the predetermined temperature range. Accordingly, the temperature of hot water that is to be discharged from the water discharge part can be reduced or increased over a plurality of stages, and the temperature of hot water to be discharged can be reduced or increased without placing much burden on the body of the bathing person.

Furthermore, for example, in the case where the temperature modification part includes a water supply channel that is connected to the circulation channel and that is for supplying hot water or water from an external supply source, the controller causes, in the water discharge temperature adjustment mode, hot water or water at a lower temperature than the temperature of hot water in the bathtub main body or hot water at a higher temperature than the temperature of hot water in the bathtub main body to be supplied from the water supply channel to the circulation channel such that the temperature of hot water to be discharged from the water discharge part is reduced or increased, over a plurality of stages, from the temperature of hot water in the bathtub main body to a target temperature within the predetermined temperature range. Accordingly, the temperature of hot water that is to be discharged from the water discharge part can be reduced or increased over a plurality of stages, and the temperature of hot water to be discharged can be reduced or increased without placing much burden on the body of the bathing person.

In the present invention, preferably, in the water discharge temperature adjustment mode, the controller reduces the temperature of hot water discharged from the water discharge part in such a way that a reduction rate of reduction in the temperature of hot water in a first stage among the plurality of stages is greater than the reduction rate in a second stage, or the controller increases the temperature of hot water discharged from the water discharge part in such a way that an increase rate of increase in the temperature of hot water in the first stage among the plurality of stages is greater than the increase rate in the second stage.

In an embodiment of the present invention configured in the above manner, in the water discharge temperature adjustment mode of the controller, the temperature of hot water to be discharged from the water discharge part is reduced by the temperature modification part in such a way that the reduction rate of reduction in the temperature of hot water discharged from the water discharge part in the first stage among the plurality of stages is greater than the reduction rate in the second stage. Accordingly, the temperature of hot water to be discharged from the water discharge part can be made to approach the predetermined temperature range relatively quickly in the first stage among the plurality of stages, and the temperature of hot water to be discharged can be made to relatively quickly approach the predetermined temperature range that is the recommended temperature zone in which a bathing person can be comfortably warmed, and then, the temperature of hot water to be discharged can be relatively gradually reduced, and the bathing person is allowed to keep feeling temperature reduction and a cooling sensation and stimulation based on change in temperature can continue to be provided while preventing the bathing person from getting used to the water discharge temperature.

Moreover, in an embodiment of the present invention configured in the above manner, in the water discharge temperature adjustment mode of the controller, the temperature of hot water to be discharged from the water discharge part is increased, by the temperature modification part, in such a way that the increase rate of increase in the temperature of hot water to be discharged from the water discharge part in the first stage among the plurality of stages is greater than the increase rate in the second stage. Accordingly, the temperature of hot water to be discharged from the water discharge part can be made to approach the predetermined temperature range relatively quickly in the first stage among the plurality of stages, and the temperature of hot water to be discharged can be made to relatively quickly approach the predetermined temperature range that feels comfortable to the bathing person, and then, the temperature of hot water to be discharged can be relatively gradually increased, and the bathing person is allowed to keep feeling temperature increase and a warming sensation and stimulation based on change in temperature can continue to be provided while preventing the bathing person from getting used to the water discharge temperature.

Furthermore, for example, in the case where the temperature modification part includes a water supply channel that is connected to the circulation channel and that is for supplying hot water or water from an external supply source, in the water discharge temperature adjustment mode of the controller, hot water or water at a lower temperature than the temperature of hot water in the bathtub main body is supplied from the water supply channel to the circulation channel in such a way that the reduction rate of reduction in the temperature of hot water discharged from the water discharge part in the first stage among the plurality of stages is greater than the reduction rate in the second stage. Accordingly, the temperature of hot water to be discharged from the water discharge part can be made to approach the predetermined temperature range relatively quickly in the first stage among the plurality of stages, and the temperature of hot water to be discharged can be made to relatively quickly approach the predetermined temperature range that is the recommended temperature zone in which a bathing person can be comfortably warmed, and then, the temperature of hot water to be discharged can be relatively gradually reduced, and the bathing person is allowed to keep feeling temperature reduction and a cooling sensation and stimulation based on change in temperature can continue to be provided while preventing the bathing person from getting used to the water discharge temperature.

Furthermore, for example, in the case where the temperature modification part includes a water supply channel that is connected to the circulation channel and that is for supplying hot water or water from an external supply source, in the water discharge temperature adjustment mode of the controller, the temperature of hot water to be discharged from the water discharge part is increased in such a way that the increase rate of increase in the temperature of hot water to be discharged from the water discharge part in the first stage among the plurality of stages is greater than the increase rate in the second stage. Accordingly, the temperature of hot water to be discharged from the water discharge part can be made to approach the predetermined temperature range relatively quickly in the first stage among the plurality of stages, and the temperature of hot water to be discharged can be made to relatively quickly approach the predetermined temperature range that is the recommended temperature zone in which a bathing person can be comfortably warmed, and then, the temperature of hot water to be discharged can be relatively gradually increased, and the bathing person is allowed to keep feeling temperature increase and a warming sensation and stimulation based on change in temperature can continue to be provided while preventing the bathing person from getting used to the water discharge temperature.

In the present invention, preferably, in the water discharge temperature adjustment mode, the controller reduces the temperature of hot water discharged from the water discharge part in such a way that a reduction time of reduction in the temperature of hot water in a first stage among the plurality of stages is shorter than the reduction time in a second stage, or the controller increases the temperature of hot water discharged from the water discharge part in such a way that an increase time of increase in the temperature of hot water in the first stage among the plurality of stages is shorter than the increase time in the second stage.

In an embodiment of the present invention configured in the above manner, in the water discharge temperature adjustment mode of the controller, the temperature of hot water to be discharged from the water discharge part is reduced by the temperature modification part in such a way that the reduction time of reduction in the temperature of hot water discharged from the water discharge part in the first stage among the plurality of stages is shorter than the reduction time in the second stage. Accordingly, the temperature of hot water to be discharged from the water discharge part can be made to approach the predetermined temperature range in a relatively short time in the first stage among the plurality of stages, and the temperature of hot water to be discharged can be made to relatively quickly approach the predetermined temperature range that is the recommended temperature zone in which a bathing person can be comfortably warmed, and then, the temperature of hot water to be discharged can be reduced over a relatively long time, and the bathing person is allowed to keep feeling temperature reduction and a cooling sensation and stimulation based on change in temperature can continue to be provided while preventing the bathing person from getting used to the water discharge temperature. Furthermore, by making the time when a temperature change is applied to the naked bathing person taking a bath relatively short in the first stage at the beginning, and then, making the time when a temperature change is applied to the bathing person longer in the next second stage, the temperature of hot water that is discharged may be reduced without placing much burden on the body of the bathing person.

Furthermore, in an embodiment of the present invention configured in the above manner, in the water discharge temperature adjustment mode of the controller, the temperature of hot water to be discharged from the water discharge part is increased by the temperature modification part in such a way that the increase time of increase in the temperature of hot water to be discharged from the water discharge part in the first stage among the plurality of stages is shorter than the increase time in the second stage. Accordingly, the temperature of hot water to be discharged from the water discharge part can be made to approach the predetermined temperature range in a relatively short time in the first stage among the plurality of stages, and the temperature of hot water to be discharged can be made to relatively quickly approach the predetermined temperature range that feels comfortable to the bathing person, and then, the temperature of hot water to be discharged can be relatively gradually reduced, and the bathing person is allowed to keep feeling temperature increase and a warming sensation and stimulation based on change in temperature can continue to be provided while preventing the bathing person from getting used to the water discharge temperature that is increased. Furthermore, by making the time when a temperature change is applied to the naked bathing person taking a bath relatively short in the first stage at the beginning, and then, making the time when a temperature change is applied to the bathing person longer in the next second stage, the temperature of hot water that is discharged may be increased without placing much burden on the body of the bathing person.

Furthermore, for example, in the case where the temperature modification part includes a water supply channel that is connected to the circulation channel and that is for supplying hot water or water from an external supply source, in the water discharge temperature adjustment mode of the controller, the temperature of hot water to be discharged from the water discharge part is reduced by the temperature modification part in such a way that the reduction time of reduction in the temperature of hot water discharged from the water discharge part in the first stage among the plurality of stages is shorter than the reduction time in the second stage. Accordingly, the temperature of hot water to be discharged from the water discharge part can be made to approach the predetermined temperature range in a relatively short time in the first stage among the plurality of stages, and the temperature of hot water to be discharged can be made to relatively quickly approach the predetermined temperature range that is the recommended temperature zone in which a bathing person can be comfortably warmed, and then, the temperature of hot water to be discharged can be reduced over a relatively long time, and the bathing person is allowed to keep feeling temperature reduction and a cooling sensation and stimulation based on change in temperature can continue to be provided while preventing the bathing person from getting used to the water discharge temperature. Furthermore, by making the time when a temperature change is applied to the naked bathing person taking a bath relatively short in the first stage at the beginning, and then, making the time when a temperature change is applied to the bathing person longer in the next second stage, the temperature of hot water that is discharged may be reduced without placing much burden on the body of the bathing person.

Furthermore, for example, in the case where the temperature modification part includes a water supply channel that is connected to the circulation channel and that is for supplying hot water or water from an external supply source, in the water discharge temperature adjustment mode of the controller, the temperature of hot water to be discharged from the water discharge part is increased in such a way that the increase time of increase in the temperature of hot water to be discharged from the water discharge part in the first stage among the plurality of stages is shorter than the increase time in the second stage. Accordingly, the temperature of hot water to be discharged from the water discharge part can be made to approach the predetermined temperature range in a relatively short time in the first stage among the plurality of stages, and the temperature of hot water to be discharged can be made to relatively quickly approach the predetermined temperature range that is the recommended temperature zone in which a bathing person can be comfortably warmed, and then, the temperature of hot water to be discharged can be relatively gradually reduced, and the bathing person is allowed to keep feeling temperature increase and a warming sensation and stimulation based on change in temperature can continue to be provided while preventing the bathing person from getting used to the water discharge temperature that is increased. Furthermore, by making the time when a temperature change is applied to the naked bathing person taking a bath relatively short in the first stage at the beginning, and then, making the time when a temperature change is applied to the bathing person longer in the next second stage, the temperature of hot water that is discharged may be increased without placing much burden on the body of the bathing person.

In the present invention, preferably, the water discharge temperature adjustment mode includes temperature change suppression control conducted between the first stage and the second stage, in which a reduction in the temperature is smaller than in either of the first stage and the second stage, or the temperature change suppression control conducted between the first stage and the second stage, in which an increase in the temperature is smaller than in either of the first stage and the second stage.

In an embodiment of the present invention configured in the above manner, the water discharge temperature adjustment mode of the controller includes the temperature change suppression control according to which a reduction in the temperature is smaller between the first stage and the second stage among the plurality of stages than in either of the first stage and the second stage. Accordingly, after the temperature of hot water to be discharged from the water discharge part is reduced in the first stage, the bathing person is provided with an opportunity to get used to the water discharge temperature that is reduced, and it is possible to prevent much burden from being placed on the body of the bathing person. Moreover, because the temperature of hot water to be discharged is reduced in the second stage after the body of the bathing person gets used to the water discharge temperature that is reduced in the first stage, even less burden is placed on the body of the bathing person.

Furthermore, in an embodiment of the present invention configured in the above manner, the water discharge temperature adjustment mode of the controller includes the temperature change suppression control according to which an increase in the temperature is smaller between the first stage and the second stage among the plurality of stages than in either of the first stage and the second stage. Accordingly, after the temperature of hot water to be discharged from the water discharge part is increased in the first stage, the bathing person is provided with an opportunity to get used to the water discharge temperature that is increased, and it is possible to prevent much burden from being placed on the body of the bathing person. Moreover, because the temperature of hot water to be discharged is increased in the second stage after the body of the bathing person gets used to the water discharge temperature that is increased in the first stage, even less burden is placed on the body of the bathing person.

In the present invention, preferably, in the water discharge temperature adjustment mode, an execution time of the temperature change suppression control is longer than an execution time of the first stage.

In an embodiment of the present invention configured in the above manner, in the water discharge temperature adjustment mode of the controller, the execution time of the temperature change suppression control is longer than the reduction time in the first stage. Accordingly, a longer time can be secured as the execution time of the temperature change suppression control for allowing the bathing person to get used to the water discharge temperature that is reduced, and even less burden is placed on the body of the bathing person.

Furthermore, in an embodiment of the present invention configured in the above manner, in the water discharge temperature adjustment mode of the controller, the execution time of the temperature change suppression control is longer than the increase time in the first stage. Accordingly, a longer time can be secured as the execution time of the temperature change suppression control when the temperature change is relatively small, and even less burden is placed on the body of the bathing person.

In the present invention, preferably, in the water discharge temperature adjustment mode, an execution time of the temperature change suppression control is shorter than an execution time of the second stage.

In an embodiment of the present invention configured in the above manner, in the water discharge temperature adjustment mode of the controller, the execution time of the temperature change suppression control is shorter than the reduction time in the second stage. Accordingly, by making the reduction time in the second stage longer while securing the execution time of the temperature change suppression control for allowing the bathing person to get used to the water discharge temperature that is reduced, the temperature of hot water that is discharged can be reduced without placing much burden on the body of the bathing person.

Furthermore, in an embodiment of the present invention configured in the above manner, in the water discharge temperature adjustment mode of the controller, the execution time of the temperature change suppression control is shorter than the increase time in the second stage. Accordingly, by making the increase time in the second stage longer while securing the execution time of the temperature change suppression control for allowing the bathing person to get used to the water discharge temperature that is increased, the temperature of hot water that is discharged can be increased without placing much burden on the body of the bathing person.

In the present invention, preferably, the temperature modification part includes a water supply channel connected to the circulation channel and the water supply channel supplies hot water or water from an external supply source.

In an embodiment of the present invention configured in the above manner, the controller includes a water discharge temperature adjustment mode in which, in the case where the temperature of hot water in the bathtub main body detected by the sensing unit is higher than the upper limit temperature of the predetermined temperature range, water discharge is performed, for a predetermined period of time from reception of a command to start control, from the water discharge part toward the inside of the bathtub main body by circulating hot water that is drawn in from the water intake port part, and after a lapse of the predetermined period of time, the temperature of hot water to be discharged from the water discharge part is reduced to within the predetermined temperature range by supplying, from the water supply channel to the circulation channel, hot water or water at a lower temperature than the temperature of hot water in the bathtub main body detected by the sensing unit. Accordingly, even in a case where a bathing person wants to take a bath with the temperature of hot water in the bathtub main body being at a temperature higher than the upper limit temperature of the predetermined temperature range that is often found desirable by a bathing person, for example, the temperature of hot water that is discharged from the water discharge part and poured directly onto the upper body, such as the neck and shoulders, of the bathing person can be reduced to within the predetermined temperature range without adjusting the temperature of hot water in the bathtub main body to within the predetermined temperature range, and thus, the bathing person can be prevented from becoming dizzy, and can be allowed to take a relatively long bath. Furthermore, for a predetermined period of time from start of control in the water discharge temperature adjustment mode, water discharge from the water discharge part is performed by circulating hot water drawn in from the water intake port part, and a drastic temperature change may be prevented from being applied to a naked bathing person taking a bath, and thus, a bath can be taken without much burden being placed on the body of the bathing person.

Advantageous Effects of Invention

With the bathtub device of the present invention, a bathing person may be prevented from becoming dizzy, and thus, the bathing person can be allowed to take a relatively long bath. Furthermore, with the bathtub device of the present invention, a bathing person can be allowed to take a bath at a comfortable bathing temperature, and the bathing person can be warmed by water that is discharged in such a way that a burden is not placed on a body of the bathing person.

DESCRIPTION OF EMBODIMENTS

A bathtub device according to a first embodiment of the present invention will be described with reference to the appended drawings. Embodiments of the present disclosure are described as examples, and it will be clear to a person skilled in the art that many modifications, changes, and replacements can be made within the gist and scope of the present invention. Accordingly, the present invention is not limited to the embodiments of the disclosure, and forms and details can be modified and changed in various ways without departing from the scope of the claims.

Figure 1:
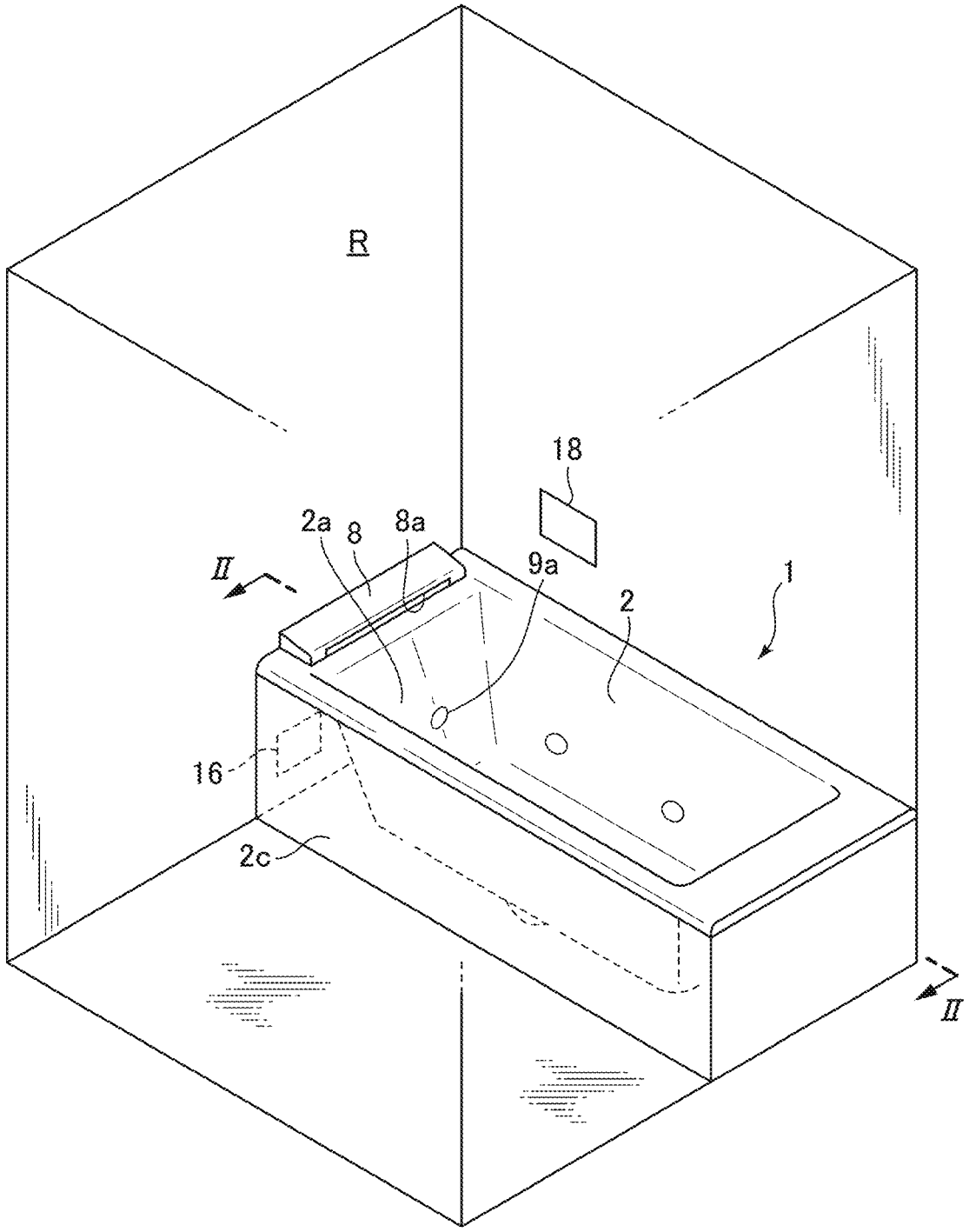
FIG. 1 is a perspective view showing an entire bathroom where a bathtub device according to a first embodiment of the present invention is installed.
Figure 2:
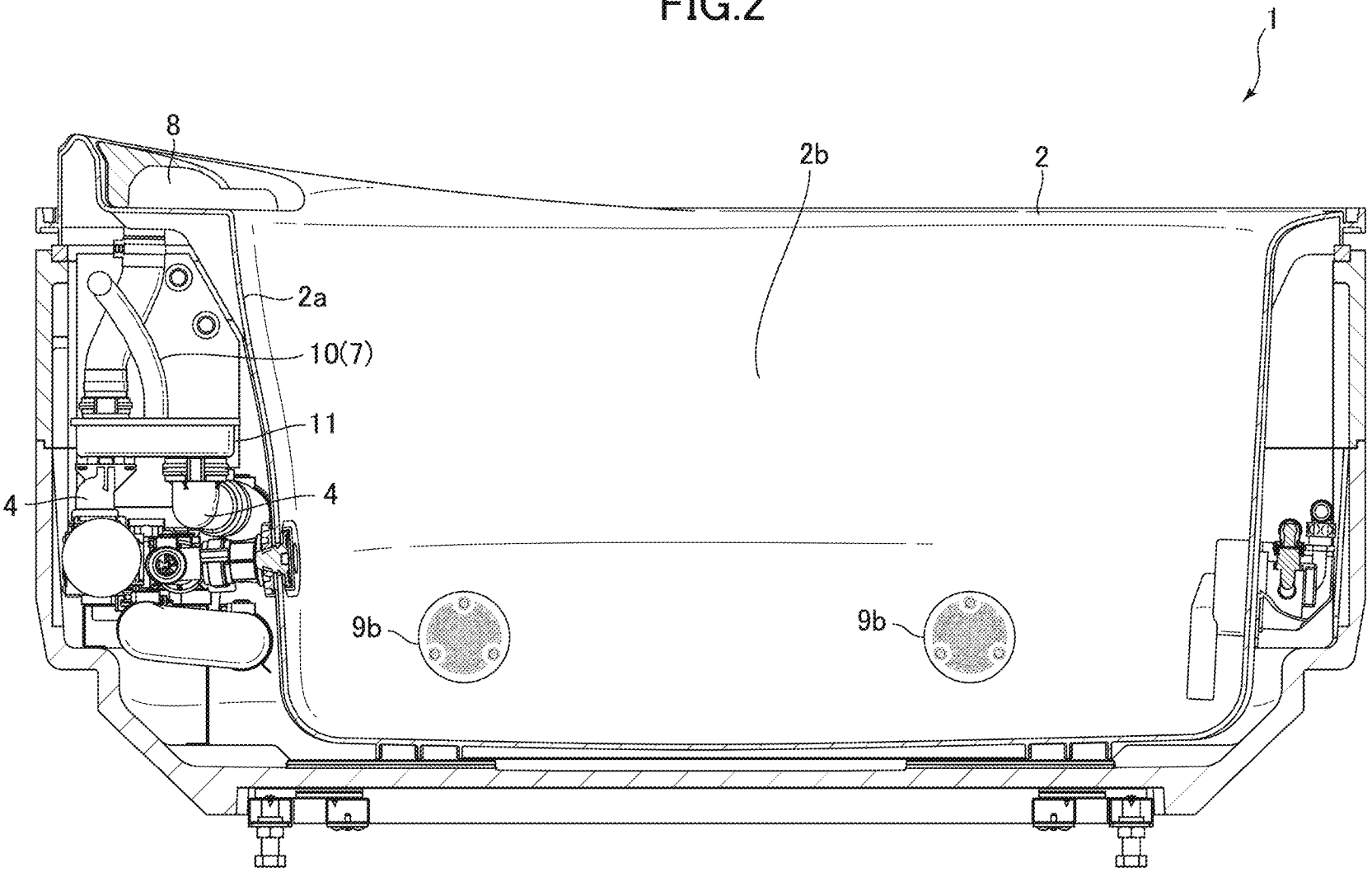
FIG. 2 is a cross-sectional view taken along a line II-II in FIG. 1.
Figure 3:
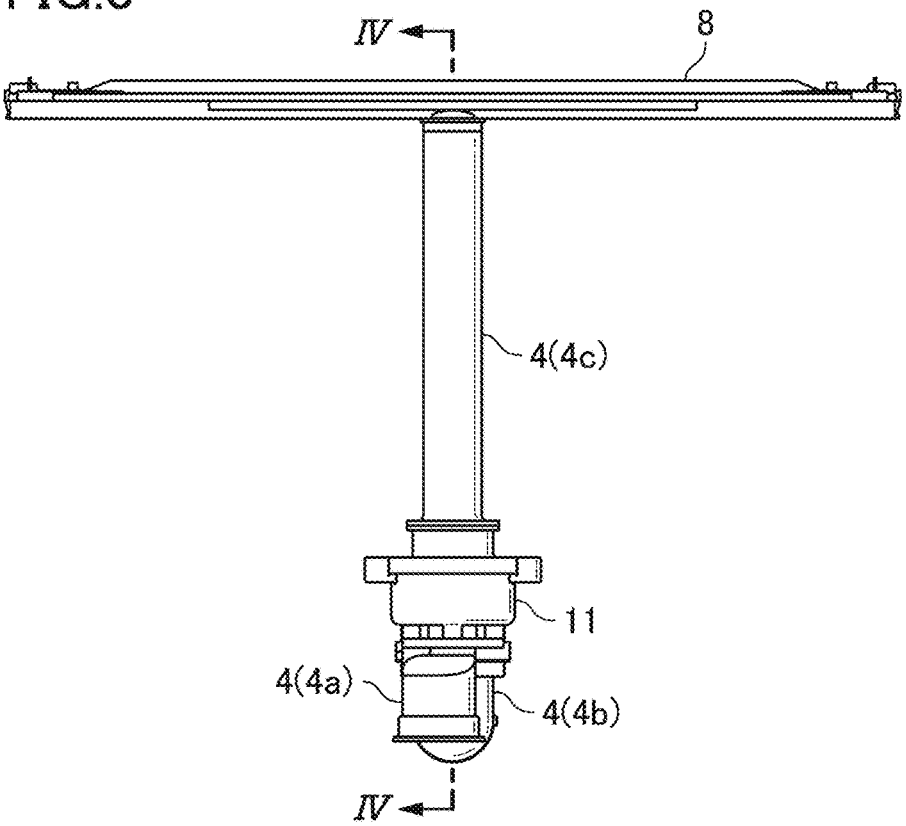
FIG. 3 is a side view showing a state where a water discharge device, a circulation channel, and a chamber of the bathtub device according to the first embodiment of the present invention are seen sideways along a short side of a bathtub main body.
Figure 4:
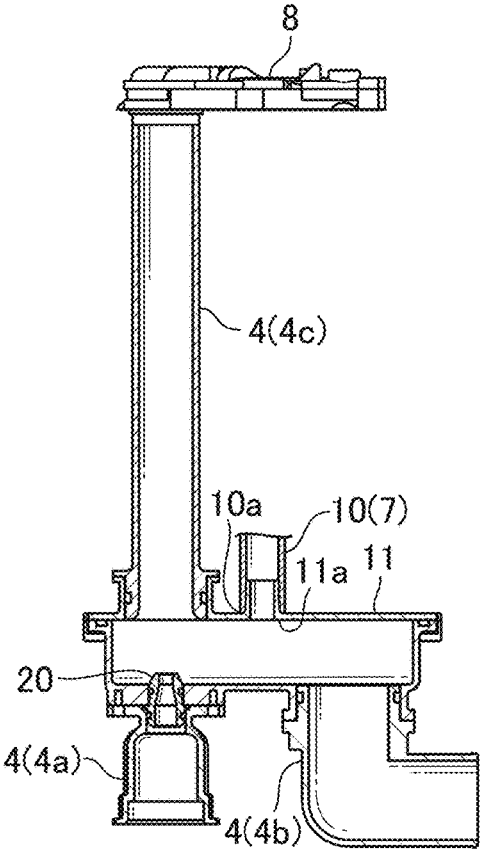
FIG. 4 is a cross-sectional view taken along a line IV-IV in FIG. 3.
Figure 5:
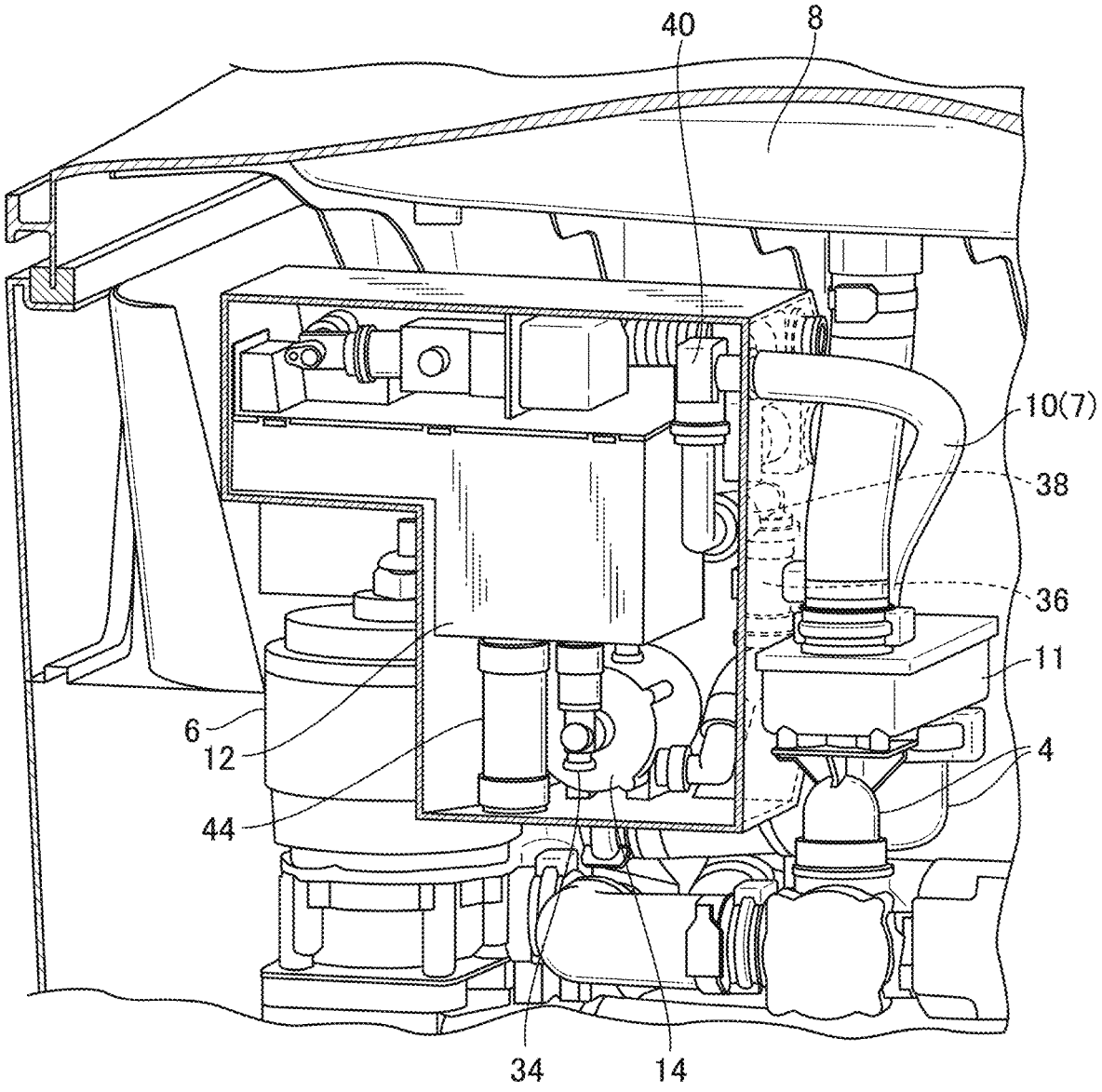
FIG. 5 is a perspective view showing the circulation channel, a water supply channel, a reservoir part and the like that are disposed on a back side of the bathtub main body of the bathtub device according to the first embodiment of the present invention.
Figure 6:
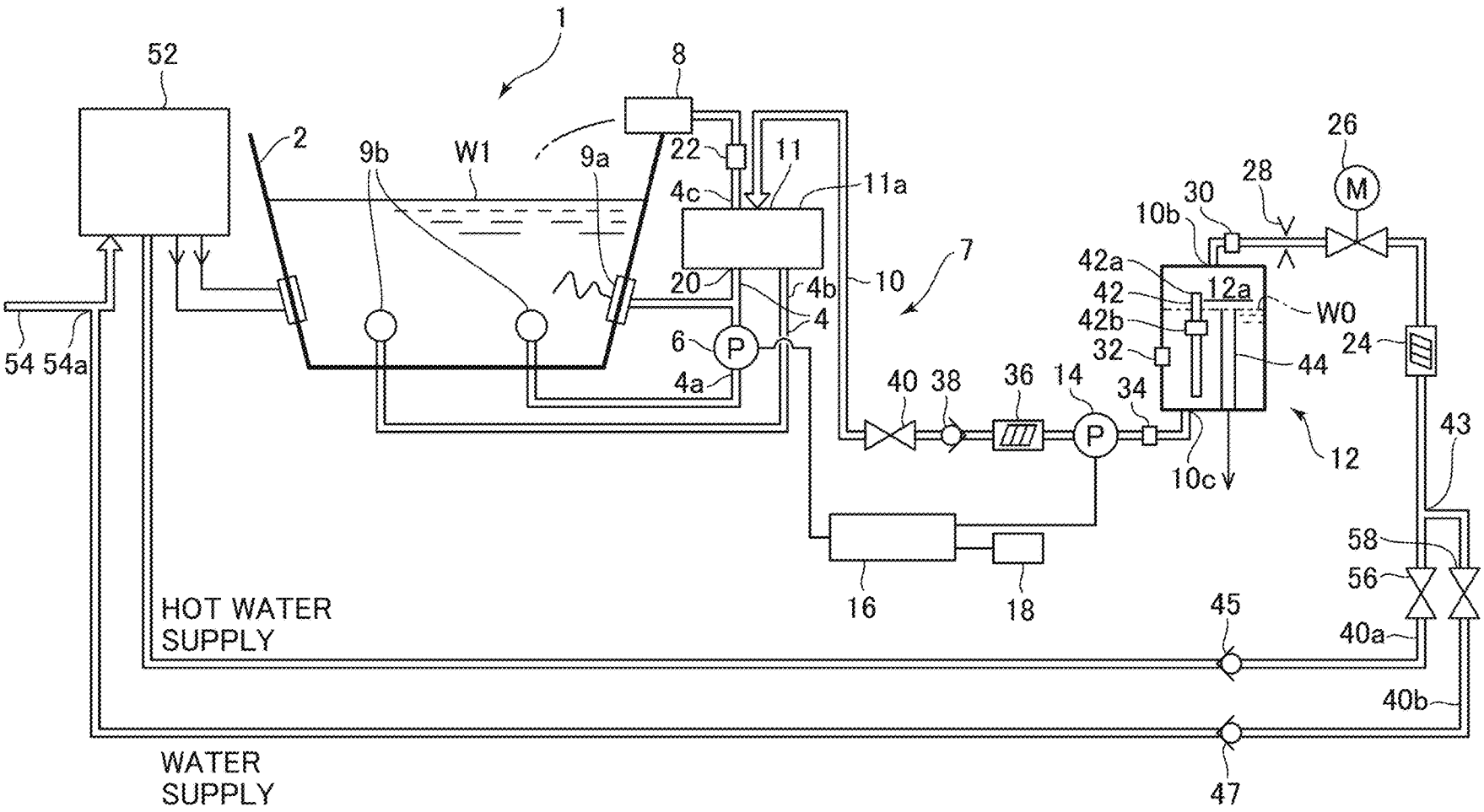
FIG. 6 is a diagram showing a supply system for hot water of the bathtub device according to the first embodiment of the present invention.

FIG. 1 is a perspective view showing an entire bathroom where a bathtub device according to the first embodiment of the present invention is installed, FIG. 2 is a cross-sectional view taken along a line II-II in FIG. 1, FIG. 3 is a side view showing a state where a water discharge device, a circulation channel, and a chamber of the bathtub device according to the first embodiment of the present invention are seen sideways along a short side of a bathtub main body, FIG. 4 is a cross-sectional view taken along a line IV-IV in FIG. 3, FIG. 5 is a perspective view showing the circulation channel, a water supply channel, a reservoir part and the like that are disposed on a back side of the bathtub main body of the bathtub device according to the first embodiment of the present invention, and FIG. 6 is a diagram showing a supply system for hot water of the bathtub device according to the first embodiment of the present invention.

As shown in FIG. 1, a bathtub device 1 according to the first embodiment of the present invention is a bathtub device that is installed in a bathroom R, and that supplies hot water to a bathtub. The bathtub device 1 according to the first embodiment of the present invention includes a bathtub main body 2, a water intake port part (bathtub water intake port) 9*b* for drawing in hot water in the bathtub main body 2, a water discharge device 8 that is a water discharge part that is provided above the bathtub main body 2 and that discharges hot water drawn in from the water intake port part 9*b* toward inside of the bathtub main body 2, a circulation channel 4 that causes the water intake port part 9*b* and the water discharge device 8 to communicate, a first pump (circulation pump) 6 that is a circulation pump that is provided on the circulation channel 4 and that feeds, in the circulation channel 4, hot water drawn in from the water intake port part 9*b*, a temperature modification part 7 for adjusting a temperature of hot water that is supplied to the water discharge device 8, a water supply channel (supply conduit) 10 that is connected to the circulation channel 4 and that supplies hot water or water from an external supply source so as to adjust that a temperature of hot water in the circulation channel 4, a reservoir part 12 that is provided on the water supply channel (supply conduit) 10 and that stores hot water or water that is supplied, a second pump (pressure pump) 14 that is provided on the water supply channel 10, on a downstream side of the reservoir part 12, and that feeds hot water or water in the reservoir part 12 toward the circulation channel 4, a first temperature sensor (water discharge temperature sensor) 22 that is provided on the circulation channel 4 and that measures the temperature of hot water in the circulation channel 4, and a controller 16 for controlling the first pump 6 and the second pump 14.

The bathtub device 1 functions as a circulation device that takes in hot water in the bathtub main body 2 from the water intake port part 9*b* and that causes the hot water to be circulated from the water discharge device 8 toward inside of the bathtub main body 2. Furthermore, a remote control 18 is attached to a wall surface of the bathroom R, and the bathtub device 1 can be operated by the remote control 18. The remote control 18 receives an operation input for temperature adjustment performed by a bathing person. The remote control 18 is electrically connected to the controller 16, and can transmit an operation input signal to the controller 16. The remote control 18 is disposed inside the bathroom R, but may instead be disposed outside the bathroom R. Moreover, a temperature of hot water in the bathtub main body 2, a temperature of hot water to be discharged from the water discharge device 8, an upper limit temperature T2 and a lower limit temperature T1 of a predetermined temperature range T, and the like may be freely set by the remote control 18. Moreover, a time such as a time t1, . . . , 4 at which a water discharge temperature adjustment mode is to be stopped can also be freely set. The controller 16 is capable of performing predetermined control based on the temperature that is set.

The bathtub main body 2 has a substantially rectangular box shape in plan view, and is formed to store hot water inside. In the present embodiment, the bathtub main body 2 is installed with one long side and two short sides on both sides of the long side entirely in contact with an inner wall surface of the bathroom R. Furthermore, an inner wall surface forming one short side of the bathtub main body 2 is a backrest surface 2*a* that is a first inner wall surface where a bathing person leans against. The water intake port part 9*b* is formed in a side wall surface 2*b* of the long side of the bathtub main body 2.

The water discharge device 8 is provided on a top edge of the bathtub main body 2. The water discharge device 8 is provided at an upper part of the backrest surface 2*a* of the bathtub main body 2, and is configured to discharge hot water toward inside of the bathtub main body 2. In the present embodiment, the water discharge device 8 includes a flat, wide water discharge port 8*a* that extends along a top edge of the backrest surface 2*a*, and is capable of discharging hot water toward neck, shoulders and back of a bathing person leaning against the backrest surface 2*a*. Furthermore, the water discharge device 8 causes a part of hot water drawn in from the water intake port part 9*b* to be discharged from the water discharge port 8*a*. Hot water in the bathtub main body 2 thus circulates by being sucked in from the water intake port part 9*b* and discharged from the water discharge port 8*a* to flow into the bathtub main body 2. Furthermore, a part of hot water drawn in from the water intake port part 9*b* is discharged from a bathtub water discharge port 9*a* provided in the backrest surface 2*a* of the bathtub main body 2.

Furthermore, in the present embodiment, the water discharge port 8*a* of the water discharge device 8 is formed to be flat and wide, and thus, hot water that is discharged from the water discharge port 8*a* is discharged in the form of a wide, strip-shaped water film, and the hot water lands on a water surface of hot water stored in the bathtub main body 2, at a position away from the backrest surface 2*a*. Moreover, in the present embodiment, the water discharge device 8 is configured such that pressure intensity of the first pump 6 can be switched in three stages of "high", "medium", and "low".

The circulation channel 4 extends from the water intake port part 9*b* to the water discharge port 8*a* of the water discharge device 8. The bathtub device 1 sucks hot water in the bathtub main body 2 from the water intake port part 9*b* provided in the inner wall surface of the bathtub main body 2, and discharges hot water into the bathtub main body 2 via the circulation channel 4 and from the water discharge port 8*a* of the water discharge device 8. The circulation channel 4 branches, on a downstream side of the first pump 6, into a flow channel on a side of the bathtub water discharge port 9*a* provided in the backrest surface 2*a* of the bathtub main body 2, and a flow channel that extends on a chamber 11 side. Accordingly, a part of hot water sucked in from the water intake port part 9*b* is blown as bathtub water from the bathtub water discharge port 9*a* provided in the backrest surface 2*a* of the bathtub main body 2 via the circulation channel 4.

The circulation channel 4 includes the chamber 11, provided halfway along the circulation channel, for drawing in hot water inside the bathtub main body 2, an injection part side flow channel (first conduit) 4*a* where the first pump 6 is provided, an introduction flow channel (second conduit) 4*b*, connected to the chamber 11, for introducing hot water inside the bathtub main body 2 into the chamber 11, and a water discharge device side flow channel (third conduit) 4*c* extending from the chamber 11 to the water discharge device 8.

A jet nozzle (nozzle) 20 is provided at an outlet of the injection part side flow channel 4*a* to the chamber 11. The jet nozzle 20 is disposed on the downstream side of the first pump 6, and forms an injection part that injects hot water supplied from the first pump 6 in such a way that the hot water passes through the chamber 11. Hot water that is injected by the jet nozzle 20 draws in hot water inside the chamber 11 by a jet pumping effect, and a flow rate of hot water drawn in from the chamber 11 is added to a flow rate of hot water that is injected by the jet nozzle 20, and hot water is thereby supplied to the water discharge device side flow channel 4*c* at a high flow rate. The water discharge device side flow channel 4*c* extends along an extension line of the jet nozzle 20.

The first pump 6 feeds the hot water inside the injection part side flow channel 4*a* toward the jet nozzle 20 under pressure, and causes the hot water supplied from the first pump 6 to be injected to pass through the chamber 11. A rotating speed of a rotating body inside the first pump 6 can be changed. Accordingly, by changing the rotating speed of the rotating body inside the first pump 6, a set flow rate of hot water to be fed to the downstream side can be changed.

The chamber 11 is positioned below a specific water level W1 inside the bathtub main body 2 (for example, a predetermined water level necessary at the time of using the water discharge device 8), and the chamber 11 is filled with hot water in the bathtub main body 2. The chamber 11 forms a reservoir space where hot water can be stored. Accordingly, when the hot water injected by the jet nozzle 20 passes through the chamber 11, the hot water inside the chamber 11 is drawn in by the injected hot water, and a flow at a high flow rate is generated. The injection part side flow channel 4*a* and the water discharge device side flow channel 4*c* are connected to the chamber 11, the water discharge device side flow channel 4*c* being connected at an upper surface facing the injection part side flow channel 4*a*. A diameter of the water discharge device side flow channel 4*c* is greater than a bore of the jet nozzle 20. The introduction flow channel 4*b* and the water supply channel 10 are also connected to the chamber 11. Accordingly, when the hot water injected by the jet nozzle 20 draws in the hot water inside the chamber 11, the hot water inside the introduction flow channel 4*b* and the hot water or water inside the water supply channel 10 are drawn into the water discharge device side flow channel 4*c* via the chamber 11. The chamber 11, the jet nozzle 20, and the water discharge device side flow channel 4*c* form a jet pump unit, and because hot water can be supplied at a relatively high flow rate by a relatively simple structure and relatively small structural elements when supplying hot water to the water discharge device 8 at a relatively high flow rate, the bathtub device 1 that can supply hot water at a relatively high flow rate can be formed in a limited small space between the bathtub main body 2 and a casing (apron) 2*c* in the bathroom R.

Furthermore, the chamber 11 allows the hot water that is sucked in from the water intake port part 9*b* and pressurized by the first pump 6 and the hot water or water supplied from the water supply channel 10 to be mixed and supplied to the water discharge device side flow channel 4*c* on the downstream side. When hot water is flowing through the circulation channel 4, the chamber 11 is practically filled with hot water.

The first temperature sensor 22 is provided on the water discharge device side flow channel 4*c*, and measures a temperature of hot water to be discharged from the water discharge device 8. The first temperature sensor 22 also functions as a sensing unit for detecting a temperature of hot water in the bathtub main body 2. For example, the first temperature sensor 22 is a thermistor.

The temperature modification part 7 includes the water supply channel 10 that is connected to the circulation channel 4, and that is for supplying hot water or water from an external supply source to adjust a temperature of hot water in the circulation channel 4. The water supply channel 10 functions as a temperature modification part for adjusting a temperature of hot water that is supplied to the water discharge part. The water supply channel 10 forms a supply path of hot water to the circulation channel 4. At the chamber 11, the water supply channel 10 is connected to a negative pressure generation part 11*a* that generates a negative pressure by a flow of hot water flowing inside the circulation channel 4. At the chamber 11, a ceiling part (an inlet part of the water discharge device side flow channel 4*c*) in front of the jet nozzle 20 is a part where a positive pressure is generated by a flow of hot water. At the chamber 11, a ceiling part other than the ceiling part in front of the jet nozzle, a side wall part, and a bottom part form the negative pressure generation part 11*a*. A downstream end 10*a* of the water supply channel 10 connected to the chamber 11 is disposed at a part other than the ceiling part in front of the jet nozzle 20. The temperature modification part 7 may be formed from another device that, instead of the water supply channel 10, functions as the temperature modification part, such as a device such as a heater for increasing the temperature of hot water inside the circulation channel 4, or a device such as a cooler for reducing the temperature of hot water.

A high-temperature hot water supply pipe (hot water supply pipe) 40*a* and a low-temperature hot water supply pipe (water supply pipe) 40*b* are connected on an upstream side of the water supply channel 10, the high-temperature hot water supply pipe 40*a* being for supplying hot water at a higher temperature than a temperature of hot water stored in the bathtub main body 2, the low-temperature hot water supply pipe 40*b* being for supplying water at a lower temperature than the temperature of hot water stored in the bathtub main body 2.

Moreover, the high-temperature hot water supply pipe 40*a* and the low-temperature hot water supply pipe 40*b* are connected to the reservoir part 12 via a high temperature side electromagnetic valve (hot water electromagnetic valve) 56 and a low temperature side electromagnetic valve (water electromagnetic valve) 58, respectively, and start and end of supply of hot water or water is controlled by the high temperature side electromagnetic valve 56 and the low temperature side electromagnetic valve 58. Furthermore, an amount of hot water or water that flows into the reservoir part 12 from each supply pipe is controlled by a water amount proportional valve 26. Furthermore, in the present embodiment, hot water at a temperature that is higher than the temperature of hot water stored in the bathtub main body 2, such as hot water at a temperature that is set at a water heater 52, is supplied from the water heater 52 to the high-temperature hot water supply pipe 40*a*. That is, tap water supplied from waterworks 54 as an external supply source is branched at a branching portion 54*a*, and a part of the tap water is supplied to the water heater 52, and the rest flows directly into the low-temperature hot water supply pipe 40*b*. Tap water that is supplied to the water heater 52 is heated to a temperature higher than the temperature of hot water stored in the bathtub main body 2, and is supplied to the high-temperature hot water supply pipe 40*a*. A check valve 45 for preventing backflow of hot water or water is provided on the high-temperature hot water supply pipe 40*a*, and a check valve 47 for preventing backflow of water is provided on the low-temperature hot water supply pipe 40*b*.

Accordingly, in the case where the temperature of hot water in the circulation channel 4 or the reservoir part 12 is to be increased, the high temperature side electromagnetic valve 56 is opened, and hot water from the water heater 52 as an external supply source is supplied to the reservoir part 12. In the case where the temperature of hot water in the circulation channel 4 or the reservoir part 12 is to be reduced, the low temperature side electromagnetic valve 58 is opened, and tap water supplied from the low-temperature hot water supply pipe 40*b* is supplied to the reservoir part 12. Additionally, the high temperature side electromagnetic valve 56 and the low temperature side electromagnetic valve 58 may be opened at the same time, and hot water and water may be mixed and supplied to the reservoir part 12 such that temperature adjustment is performed.

Furthermore, the temperature of hot water stored in the bathtub main body 2 is measured by the first temperature sensor 22, but may instead be detected by a bathtub temperature sensor attached to the bathtub main body 2. Furthermore, temperatures of hot water and water are detected, but instead, temperatures of hot water and water may be estimated based on data obtained by respective sensors.

Temperatures detected by the temperature sensors are transmitted to the controller 16, and the controller 16 adjusts a rotating speed of the second pump 14 based on the detected temperatures, and causes hot water at a required temperature to be discharged from the water discharge device 8.

The second pump 14 feeds, under pressure, the hot water or water stored in the reservoir part 12 on the water supply channel 10 toward the chamber 11. A rotating speed of a rotating body inside the second pump 14 can be changed. Accordingly, by changing the rotating speed of the rotating body inside the second pump 14, a set flow rate of hot water to be fed to the downstream side can be changed.

The bathtub device 1 further includes a water amount sensor 24 for measuring a flow rate of hot water or water between the reservoir part 12 on the water supply channel 10 and the high temperature side electromagnetic valve 56 and the low temperature side electromagnetic valve 58, the water amount proportional valve (flow regulating valve) 26 for controlling the flow rate of hot water or water, a fixed flow valve 28 for controlling a maximum flow rate of water flow passing through a water passageway regardless of a water pressure, a second temperature sensor (inflow side temperature sensor) 30 for measuring the temperature of hot water in the water supply channel 10 flowing to the reservoir part 12, a third temperature sensor (reservoir tank temperature sensor) 32 provided inside the reservoir part 12, a fourth temperature sensor (outflow side temperature sensor) 34 for measuring the temperature of hot water or water flowing to a downstream side from the reservoir part 12, a water amount sensor 36 provided on a downstream side of the second pump 14, a check valve 38 for preventing backflow of hot water or water, and an electromagnetic valve 40 for electromagnetically opening/closing the flow channel.

The water amount sensor 24, the water amount proportional valve 26, the fixed flow valve 28, and the second temperature sensor 30 are provided between the reservoir part 12 on the water supply channel 10 and a merging portion 43 on a downstream side of the high temperature side electromagnetic valve 56 and the low temperature side electromagnetic valve 58. The merging portion 43 is a part where the high-temperature hot water supply pipe 40*a* and the low-temperature hot water supply pipe 40*b* are connected and flows from the two are merged.

The second temperature sensor 30 is provided on a flow channel on an upstream side of the reservoir part 12 on the water supply channel 10, and is for measuring the temperature of hot water or water that is supplied to the reservoir part 12 from the high-temperature hot water supply pipe 40*a* and the low-temperature hot water supply pipe 40*b*. For example, the second temperature sensor 30 is a thermistor. The third temperature sensor 32 measures the temperature of hot water or water stored in the reservoir part 12. For example, the third temperature sensor 32 is a thermistor.

The fourth temperature sensor 34, the water amount sensor 36, the check valve 38, and the electromagnetic valve 40 are provided between the reservoir part 12 on the water supply channel 10 and the chamber 11. The fourth temperature sensor 34 measures the temperature of hot water or water flowing from the reservoir part 12 to a downstream side. For example, the fourth temperature sensor 34 is a thermistor. The water amount sensor 36 is capable of measuring a flow rate of hot water or water flowing through the water supply channel 10.

The controller 16 controls supply of hot water or water from the water supply channel 10 to the circulation channel 4. The controller 16 is electrically connected to the first pump 6, the second pump 14, the remote control 18, the first temperature sensor 22, the water amount sensor 24, the water amount proportional valve 26, the second temperature sensor 30, the third temperature sensor 32, the fourth temperature sensor 34, the water amount sensor 36, the electromagnetic valve 40, the high temperature side electromagnetic valve 56, and the low temperature side electromagnetic valve 58. Such electrical connection may be partially or entirely achieved by infrared communication or wireless communication according to other methods. An arithmetic device such as a CPU and a storage device such as a memory are built in the controller 16, and the controller 16 is able to control an electrically connected appliance based on a predetermined control program or the like that is stored. For example, the controller 16 stores, in the storage device, control programs as described later for temperature adjustment preparation control, temperature adjustment control, and for otherwise supplying hot water to the bathtub.

The controller 16 includes, as a water discharge temperature adjustment mode, a dizziness prevention mode in which, in a case where the temperature of hot water in the bathtub main body 2 detected by the first temperature sensor 22 is higher than an upper limit temperature of a predetermined temperature range, the controller causes hot water drawn in from the water intake port part 9*b* to be discharged from the water discharge device 8 to the bathtub main body 2 in a circulating manner for a predetermined time after reception of a command to start control, and then, after a lapse of the predetermined time, causes hot water or water at a lower temperature than the temperature of the hot water in the bathtub main body 2 detected by the first temperature sensor 22 to be supplied from the water supply channel 10 to the circulation channel 4 so as to reduce the temperature of hot water that is discharged from the water discharge device 8 to within the predetermined temperature range.

Next, the reservoir part 12 will be described in detail.

The reservoir part 12 is formed to cut off flow channels on the upstream side and the downstream side of the water supply channel 10. The reservoir part 12 stores hot water or water up to a predetermined water level that is set by a float switch 42. Accordingly, an upper space 12*a* is formed at an upper part inside the reservoir part 12, and the reservoir part 12 is formed such that a downstream end 10*b* forming a water supply channel inlet is connected to the upper space 12*a*. A water supply channel outlet 10*c* is connected to a bottom surface of the reservoir part 12.

The reservoir part 12 is provided with the float switch 42 and an overflow pipe 44 that are disposed inside the reservoir part 12. The float switch 42 includes a stem 42*a* forming a rod-shaped shaft portion of the float switch 42, and a float portion (float) 42*b* that moves up and down along the stem 42*a* according to a change in a water level inside the reservoir part 12 by receiving buoyancy according to the water level. Accordingly, when the float portion 42*b* rises to a water level detection position along the stem 42*a* according to the water level, the float switch 42 can detect that the hot water or water inside the reservoir part 12 reached the predetermined water level at an upper part. In the case where the hot water or water is detected by the float switch 42 to have reached the predetermined water level at the upper part, the water level inside the reservoir part 12 is at least at the predetermined water level at the upper part, and the controller 16 can determine that hot water or water of a predetermined water amount is stored in the reservoir part 12. The float switch 42 is electrically connected to the controller 16.

The overflow pipe 44 is formed vertically extending inside the reservoir part 12. The overflow pipe 44 is open at the upper part inside the reservoir part 12, and the overflow pipe 44 extends from inside the reservoir part 12 to a discharge flow channel outside the reservoir part 12. Accordingly, the overflow pipe 44 is provided to prevent hot water or water from overflowing from the reservoir part 12, and in a case where the water level inside the reservoir part 12 rises above a height of an upper end opening 44*a* of the overflow pipe 44, hot water or water flows into the overflow pipe 44 to be discharged to the discharge flow channel.

Hot water supplied from the high-temperature hot water supply pipe 40*a* and water supplied from the low-temperature hot water supply pipe 40*b* are lead to the reservoir part 12, and are temporarily stored in the reservoir part 12 in a mixed state. The reservoir part 12 is formed to have a size that allows storage of a predetermined water amount. A predetermined water amount specified as a storage capacity in the reservoir part 12, below the upper end opening 44*a* of the overflow pipe 44, is greater than a volume of the chamber 11. For example, the reservoir part 12 has a storage capacity for a predetermined water amount in the range of about 0.5 L to about 3.0 L. Furthermore, the reservoir part 12 is provided above the chamber 11.

In the case of storing hot water or water in the reservoir part 12, the controller 16 controls the water amount proportional valve 26 in such a way that a flow rate (flow rate per unit time) of hot water or water flowing to a downstream side from the reservoir part 12 becomes smaller than a flow rate (flow rate per unit time) of hot water or water flowing into the reservoir part 12 from an upstream side of the reservoir part 12. In the case where a water storage amount inside the reservoir part 12 rises above a predetermined water level W0, the overflow pipe 44 is used to maintain the water level at the upper part inside the reservoir part 12 at a constant level.

In the case of supplying hot water or water from the reservoir part 12 to the chamber 11 without making the reservoir part 12 empty, the controller 16 controls the water amount proportional valve 26 in such a way that the flow rate of hot water or water flowing from the reservoir part 12 to the downstream side becomes smaller than the flow rate of hot water or water flowing into the reservoir part 12 from the upstream side of the reservoir part 12, or in such a way that the flow rate of hot water or water flowing from the reservoir part 12 to the downstream side becomes approximately the same as the flow rate of hot water or water flowing into the reservoir part 12.

Next, an operation of the bathtub device 1 according to the first embodiment of the present invention will be described with reference to FIG. 7.

Figure 7:
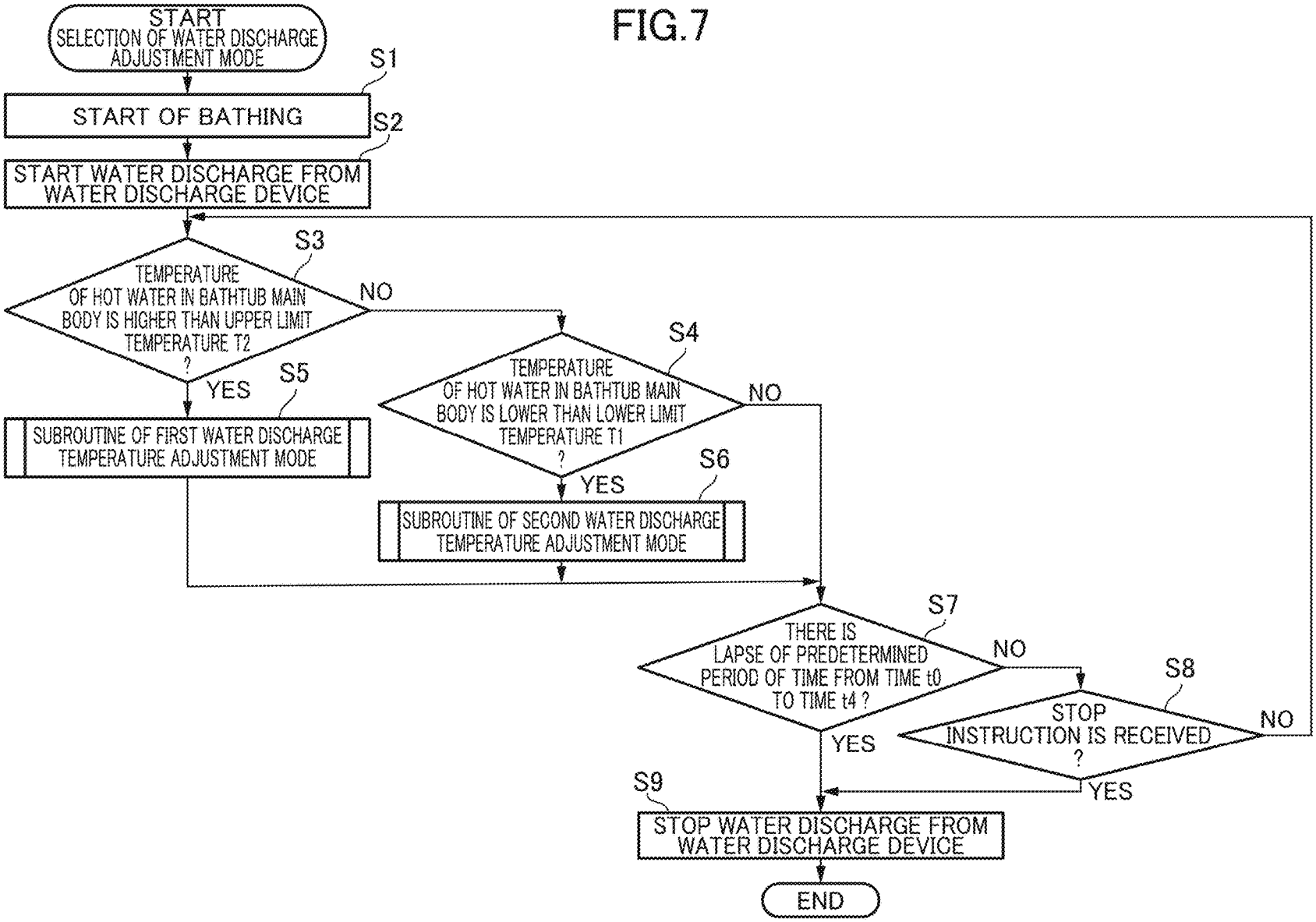
FIG. 7 is a flowchart showing an operation of the bathtub device according to the first embodiment of the present invention.
Figure 8:
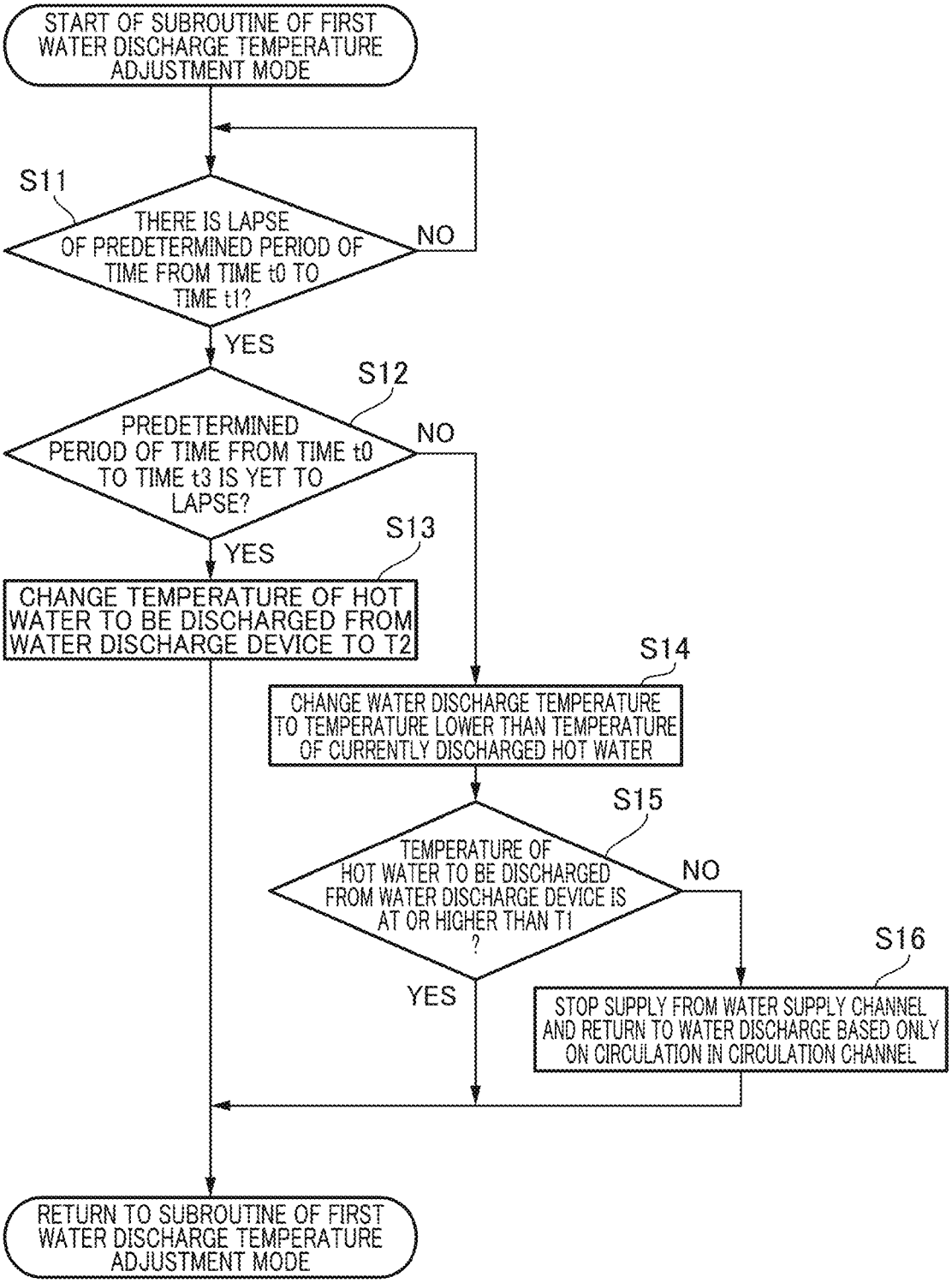
FIG. 8 is a flowchart of a subroutine of a first water discharge temperature adjustment mode among water discharge temperature adjustment modes in FIG. 7.
Figure 9:
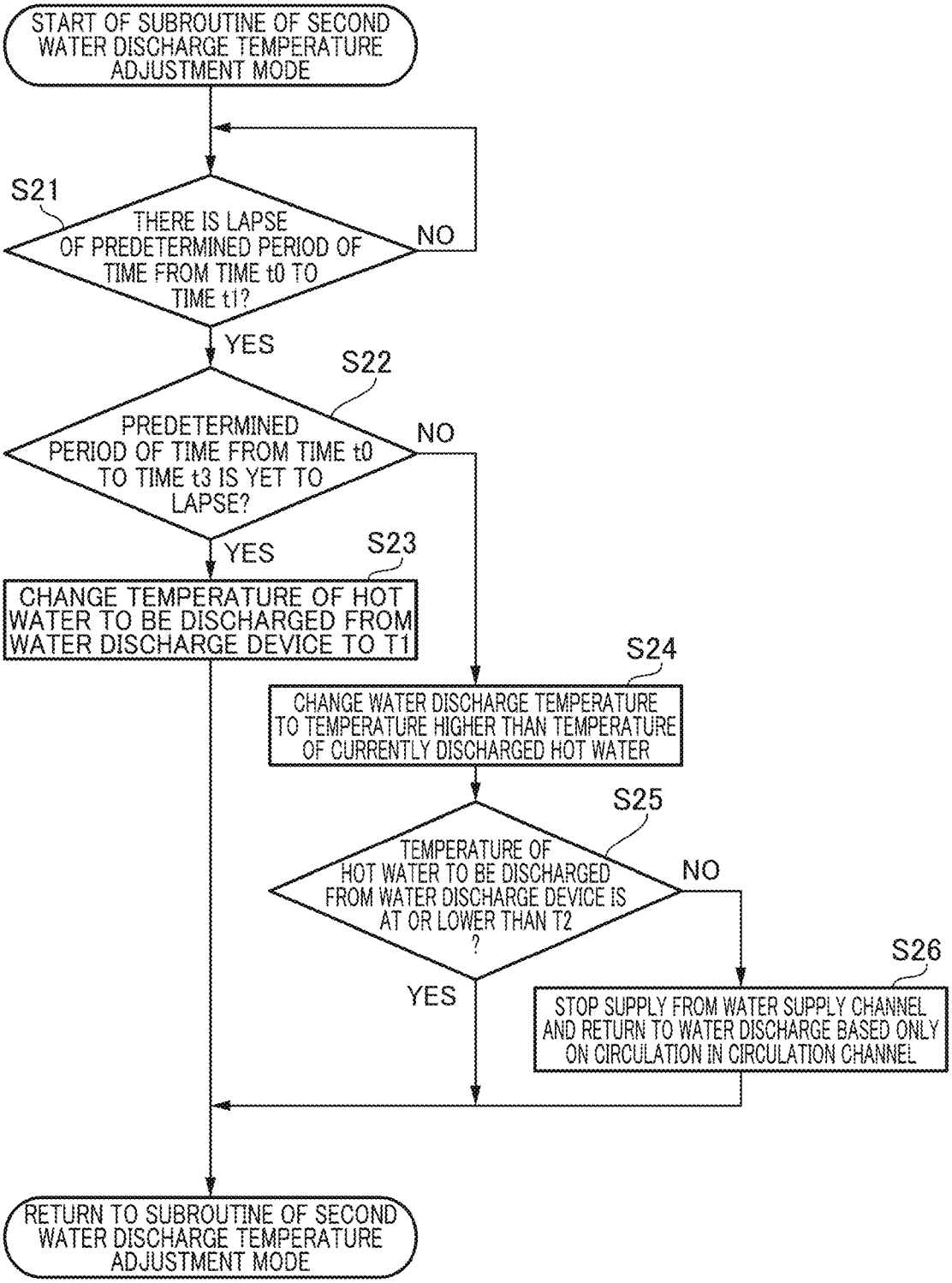
FIG. 9 is a flowchart of a subroutine of a second water discharge temperature adjustment mode among the water discharge temperature adjustment modes in FIG. 7.
Figure 10:
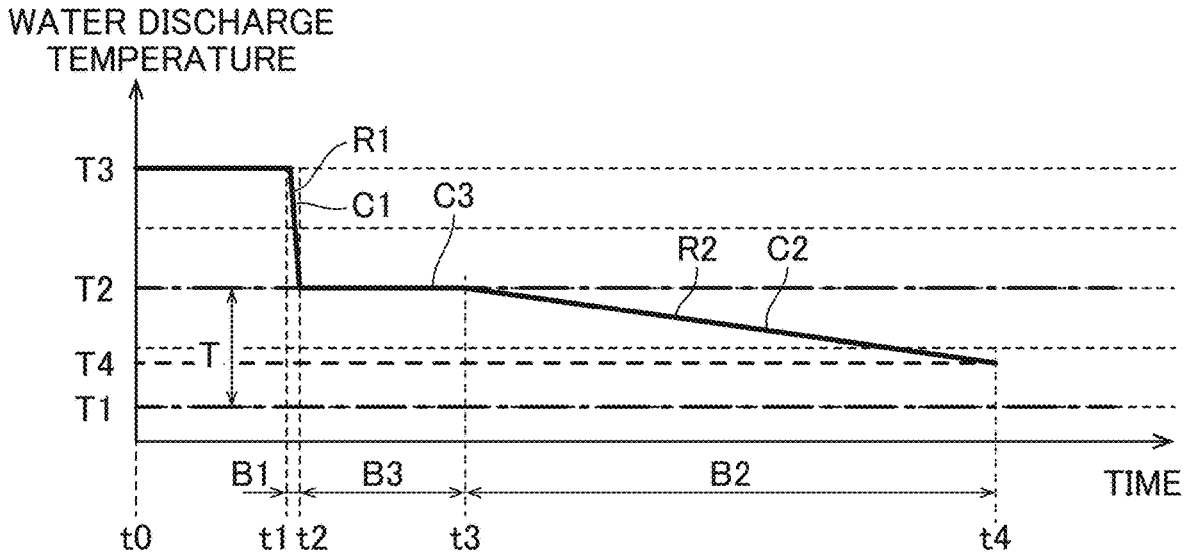
FIG. 10 is a time chart showin a relationship between time and a temperature of hot water that is discharged from the water discharge device in the first water discharge temperature adjustment mode among the water discharge temperature adjustment modes in FIG. 7.
Figure 11:
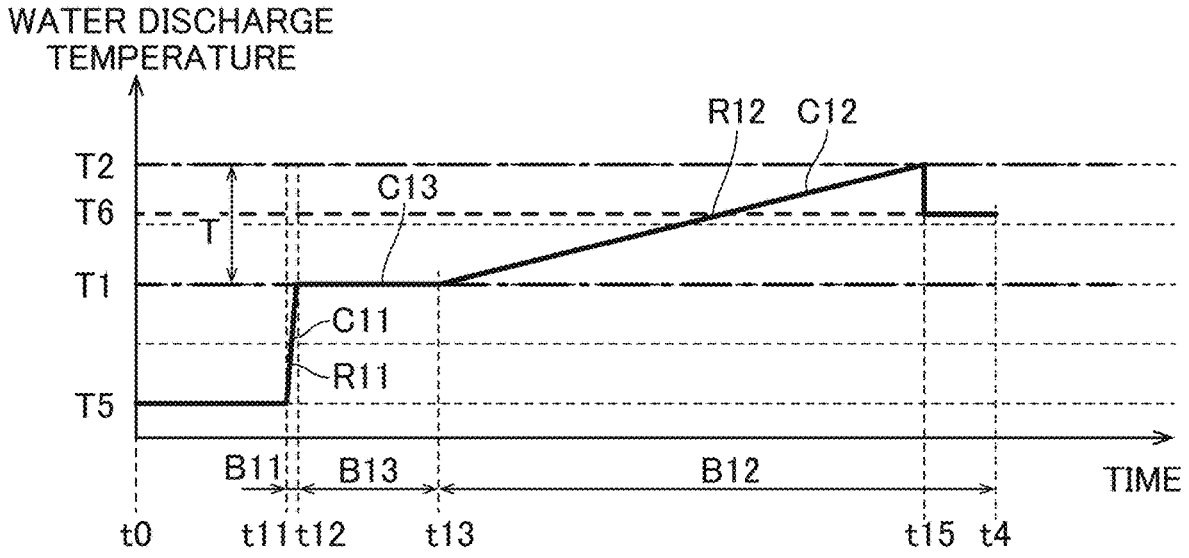
FIG. 11 is a time chart showing a relationship between time and a temperature of hot water that is discharged from the water discharge device in the second water discharge temperature adjustment mode among the water discharge temperature adjustment modes in FIG. 7.

FIG. 7 is a flowchart showing an operation of the bathtub device 1 according to the first embodiment of the present invention, FIG. 8 is a flowchart of a subroutine of a first water discharge temperature adjustment mode among water discharge temperature adjustment modes in FIG. 7, FIG. 9 is a flowchart of a subroutine of a second water discharge temperature adjustment mode among the water discharge temperature adjustment modes in FIG. 7, FIG. 10 is a time chart showing a relationship between time and a temperature of hot water that is discharged from the water discharge device in the first water discharge temperature adjustment mode among the water discharge temperature adjustment modes in FIG. 7, and FIG. 11 is a time chart showing a relationship between time and a temperature of hot water that is discharged from the water discharge device in the second water discharge temperature adjustment mode among the water discharge temperature adjustment modes in FIG. 7.

The flowchart shown in FIG. 7 is a flow showing control by the controller 16. In FIG. 7, S indicates each step.

First, at the beginning, the controller 16 receives an operation input by a bathing person for selecting a water discharge temperature adjustment mode on the remote control 18 and starts control in the water discharge temperature adjustment mode of the bathtub device 1, and proceeds to step S1. Additionally, the controller 16 may autonomously start the water discharge temperature adjustment mode based not on the operation of the remote control 18 by the bathing person but on a control program stored in the storage device of the controller 16. Furthermore, the water discharge temperature adjustment mode may also be started in a state where discharge of water from the water discharge device 8 is already started at the bathtub device 1. At a time of start, the electromagnetic valve 40, the high temperature side electromagnetic valve 56, and the low temperature side electromagnetic valve 58 are in closed state.

Next, in step S1, the controller 16 assumes that the bathing person is already taking a bath, and proceeds to S2. Additionally, the controller 16 may detect, by a human sensor or the like, start of bathing of the bathing person, and may determine that the bathing person is already taking a bath. Additionally, hot water may already be stored in the bathtub main body 2 up to the predetermined water level W1 at a time point of S1, or in the case where hot water is not stored in the bathtub main body 2 at the time point of S1, the controller 16 may cause hot water to be supplied from the water heater 52 to the bathtub main body 2 at a time point prior to S2 and cause the hot water to be supplied up to the predetermined water level W1.

In step S2, the controller 16 causes water discharge from the water discharge device 8 to be started at time to and starts operation for shoulder-bathing circulation, and proceeds to step S3. In step S2, to start discharge of water from the water discharge device 8, the controller 16 activates the first pump 6, draws in hot water inside the bathtub main body 2 from the water intake port part 9*b*, and feeds the hot water to the downstream side under pressure by the first pump 6. When hot water injected by the jet nozzle 20 draws in hot water inside the chamber 11, hot water inside the introduction flow channel 4*b* flows through the chamber 11 to be drawn into the water discharge device side flow channel 4*c*. Hot water flowing into the water discharge device side flow channel 4*c* is discharged from the water discharge device 8 toward inside of the bathtub main body 2, and is circulated into the bathtub main body 2. For example, hot water that is discharged from the water discharge device 8 is poured onto the upper body, such as the neck and shoulders, of the bathing person sitting in the bathtub main body 2 with his/her back to the water discharge device 8, and the bathing person is allowed to enjoy shoulder-bathing.

In step S3, the controller 16 acquires, by the first temperature sensor 22, as a temperature of hot water in the bathtub main body 2, a temperature of hot water to be discharged from the water discharge device 8, and determines whether the temperature of hot water in the bathtub main body 2 detected by the first temperature sensor 22 is higher than the upper limit temperature T2 of the predetermined temperature range T (see FIG. 10). In step S3, hot water or water is not supplied from the water supply channel 10 to the circulation channel 4, and hot water in the bathtub main body 2 is circulated by being discharged from the water discharge device 8 via the circulation channel 4 to return to the bathtub main body 2. Accordingly, the first temperature sensor 22 is able to detect, on the circulation channel 4, the temperature of hot water in the bathtub main body 2. Additionally, the temperature of hot water in the bathtub main body 2 may instead be detected by temperature detection means provided at a position different from that of the first temperature sensor 22, such as a position in the bathtub main body 2. In the case where the temperature of hot water in the bathtub main body 2 detected by the first temperature sensor 22 is at or lower than the upper limit temperature T2 of the predetermined temperature range T, it can be determined that the temperature of hot water in the bathtub main body 2 is relatively low and that execution of the first water discharge temperature adjustment mode among the water discharge temperature adjustment modes is not necessary, and thus, the controller 16 proceeds to S4. In the case where the temperature of hot water in the bathtub main body 2 detected by the first temperature sensor 22 is higher than the upper limit temperature T2 of the predetermined temperature range T, it can be determined that execution of the first water discharge temperature adjustment mode among the water discharge temperature adjustment modes is effective in preventing the bathing person from becoming dizzy or getting a chill rapidly after bathing, and the controller 16 proceeds to S5. For example, in FIG. 10, a temperature of hot water in the bathtub main body 2 that is higher than the upper limit temperature T2 is shown as a temperature T3. In the present embodiment, the predetermined temperature range T is set to a temperature range that is a recommended temperature zone in which a bathing person can be comfortably warmed, and is preferably set to a temperature range of about 38 °C to about 40 °C. At this time, the upper limit temperature T2 of the predetermined temperature range T is set to about 40 °C, and the lower limit temperature T1 of the predetermined temperature range T is set to about 38 °C. The predetermined temperature range T may be set to any range as a recommended temperature zone in which a bathing person can be comfortably warmed.

In step S4, the controller 16 acquires, by the first temperature sensor 22, as the temperature of hot water in the bathtub main body 2, a temperature of hot water to be discharged from the water discharge device 8, and determines whether a temperature T5 of hot water in the bathtub main body 2 detected by the first temperature sensor 22 is lower than the lower limit temperature T1 of the predetermined temperature range T. At this time, in step S4, hot water or water is not supplied from the water supply channel 10 to the circulation channel 4, and hot water in the bathtub main body 2 is circulated by being discharged from the water discharge device 8 via the circulation channel 4 to return to the bathtub main body 2. Accordingly, the first temperature sensor 22 is able to detect, on the circulation channel 4, the temperature of hot water in the bathtub main body 2. In the case where the temperature of hot water in the bathtub main body 2 detected by the first temperature sensor 22 is at or higher than the lower limit temperature T1 of the predetermined temperature range T, it can be determined that the temperature of hot water in the bathtub main body 2 is relatively high and that execution of the second water discharge temperature adjustment mode (warming mode) among the water discharge temperature adjustment modes is not necessary, and thus, the controller 16 proceeds to S7. In the case where the temperature of hot water in the bathtub main body 2 detected by the first temperature sensor 22 is lower than the lower limit temperature T1 of the predetermined temperature range T, it can be determined that the second water discharge temperature adjustment mode (warming mode) among the water discharge temperature adjustment modes is to be executed, and thus, the controller 16 proceeds to S6. For example, in FIG. 11, a temperature of hot water in the bathtub main body 2 that is lower than the lower limit temperature T1 is shown as a temperature T5.

In step S5, the controller 16 performs a subroutine of the first water discharge temperature adjustment mode among the water discharge temperature adjustment modes. Accordingly, the controller 16 starts the subroutine of the first water discharge temperature adjustment mode as shown in FIG. 8, and proceeds to S11.

In step S6, the controller 16 performs a subroutine of the second water discharge temperature adjustment mode among the water discharge temperature adjustment modes. Accordingly, the controller 16 starts the subroutine of the second water discharge temperature adjustment mode as shown in FIG. 9, and proceeds to S21.

In step S11, the controller 16 determines whether there is a lapse of a predetermined period of time from the time t0 to a time t1 as shown in FIG. 10. In the case where an elapsed time from the time to does not exceed the time t1, it can be determined that there is no lapse of a predetermined period of time from start of water discharge from the water discharge device 8, and thus, the controller 16 returns to S11 to prevent a drastic temperature change from being applied to the naked bathing person taking a bath. In the case where the elapsed time from the time to exceeds t1, it can be determined that there is a lapse of a predetermined period of time from start of water discharge from the water discharge device 8 and that the naked bathing person taking a bath is getting used to the temperature of hot water that is discharged from the water discharge device 8, and thus, the controller 16 proceeds to S12. During a time when the elapsed time in step S11 is not yet past the time t1, the controller 16 determines the temperature of hot water or water that is to be stored in the reservoir part 12 that is necessary to reduce, in S13 at a later stage, the temperature of hot water to be discharged from the water discharge device 8 from the temperature T3 of hot water in the bathtub main body 2 to the temperature T2, and controls the high temperature side electromagnetic valve 56 and/or the low temperature side electromagnetic valve 58 such that hot water or water at the determined temperature is stored in the reservoir part 12. The controller 16 can estimate, based on output or the rotating speed of the rotating body of the first pump 6, the flow rate of hot water flowing through the circulation channel 4, such as the flow rate of hot water in the injection part side flow channel 4*a* and the water discharge device side flow channel 4*c*. For example, the controller 16 can estimate the flow rate of hot water flowing through the water discharge device side flow channel 4*c*, and acquire the circulation flow rate. The controller 16 can also estimate, based on output or the rotating speed of the rotating body of the second pump 14, an amount of supply of hot water or the like from the water supply channel 10. Accordingly, the controller 16 can determine the temperature of hot water or water in the reservoir part 12 that is necessary to change the temperature of hot water in the circulation channel 4 from T3 to T2 in S13 at a later stage.

In step S12, the controller 16 determines whether a predetermined period of time from the time t0 to time t3 as shown in FIG. 10 is yet to lapse. In the case where there is a lapse of the predetermined period of time from the time to and it is past the time t3, hot water at the temperature T2 is already discharged from the water discharge device 8 until the time t3, and the controller 16 proceeds to step S14 so that control can be performed such that a gradual reduction in temperature within the predetermined temperature range T can be felt after the time t3 and a cooling sensation and stimulation based on change in temperature can be felt. In the case where the predetermined period of time from the time to is yet to lapse and the time t3 is not yet reached, the temperature of hot water in the bathtub main body is at the temperature T3 that is higher than the upper limit temperature T2 of the predetermined temperature range, and also, hot water at the temperature T3 is discharged from the water discharge device 8, and thus, it can be determined that it is helpful to reduce the temperature of hot water that is directly poured onto the upper body of the bathing person and to prevent the bathing person from getting dizzy, and the controller 16 proceeds to step S13.

In step S13, the controller 16 causes hot water or water at a temperature that is lower than the temperature T3 of hot water in the bathtub main body 2 detected by the first temperature sensor 22 to be supplied from the water supply channel 10 to the circulation channel 4, and causes the temperature of hot water to be discharged from the water discharge device 8 to be changed to the temperature T2. During S11, the controller 16 determines the temperature of hot water or water to be stored in the reservoir part 12 that is necessary to reduce the temperature of hot water to be discharged from the water discharge device 8 from the temperature T3 of hot water in the bathtub main body 2 to the temperature T2, controls the high temperature side electromagnetic valve 56 and/or the low temperature side electromagnetic valve 58, and causes hot water or water at the determined temperature to be stored in the reservoir part 12. Accordingly, the controller 16 switches the electromagnetic valve 40 from a closed state to an open state, drives the second pump 14, and causes supply to be performed from the water supply channel 10 to the circulation channel 4. The temperature T3 of hot water in the circulation channel 4 is thereby reduced to the temperature T2 due to supply of hot water or water, from the water supply channel 10, at a temperature lower than the temperature T3. The controller 16 reduces the temperature of hot water to be discharged from the water discharge device 8 to the temperature T2 at a relatively early stage, and thus, the bathing person can be prevented from becoming dizzy. Additionally, hot water or water at the determined temperature is prepared in the reservoir part 12 in advance while the elapsed time in step S11 is not yet past the time t1, and thus, the controller 16 can reduce the temperature of hot water that is discharged from the temperature T3 to the temperature T2 at a relatively early stage in S13.

In the water discharge temperature adjustment mode, the controller 16 causes hot water or water at a temperature lower than the temperature T3 of hot water in the bathtub main body 2 to be supplied from the water supply channel 10 to the circulation channel 4 in such a way that the temperature of hot water to be discharged from the water discharge device 8 is reduced, over a plurality of stages, from the temperature of hot water in the bathtub main body 2 to a temperature within the predetermined temperature range T. For example, in a first stage among the plurality of stages, the controller 16 reduces the temperature of hot water to be discharged from the water discharge device 8 from the temperature T3 of hot water in the bathtub main body 2 to the temperature T2, and in a second stage among the plurality of stages, the controller 16 reduces, as indicated in S14, the temperature of hot water to be discharged from the water discharge device 8 within the predetermined temperature range T. Accordingly, the temperature of hot water to be discharged is reduced over the plurality of stages to a temperature within the predetermined temperature range T. Accordingly, compared to a case where the temperature of hot water to be discharged from the water discharge part is reduced in one go, the temperature of hot water is reduced over the plurality of stages, and the temperature of hot water that is discharged can be reduced without placing much burden on the body of the bathing person. After changing the temperature of hot water discharged from the water discharge device 8 to the temperature T2 in step S13, the controller 16 proceeds to "return to subroutine of first water discharge temperature adjustment mode".

For example, from time t2 to the time t3, the controller 16 causes water to be continuously discharged from the water discharge device 8 while keeping the temperature of discharged hot water approximately constant at the temperature T2. In this manner, the water discharge temperature adjustment mode of the controller 16 includes temperature change suppression control that is temperature reduction suppression control according to which a reduction in temperature between a first stage C1 and a second stage C2 among the plurality of stages is smaller than reduction in temperature in either of the first stage C1 and the second stage C2. In the temperature change suppression control, the controller 16 causes water to be continuously discharged from the water discharge device 8 while keeping the temperature of discharged hot water approximately constant at the temperature T2, for example. The temperature change suppression control is performed in a third stage C3 between the first stage C1 and the second stage C2. The temperature change suppression control achieves, in the third stage C3 from the time t2 to the time t3, discharge of water with little or almost no temperature change. The temperature change suppression control is set such that the temperature is changed in the third stage C3 preferably within a range from the upper limit temperature T2+0.5 °C to the upper limit temperature T2−0.5 °C, such as a range from about 40.5 °C to about 39.5 °C. In the water discharge temperature adjustment mode of the controller 16, an execution time B3 of the temperature change suppression control is longer than a reduction time B1 in the first stage C1. In the water discharge temperature adjustment mode of the controller 16, the execution time B3 of the temperature change suppression control is shorter than a reduction time B2 in the second stage C2.

In step S14, the controller 16 changes the temperature of hot water to be discharged from the water discharge device 8 to be lower than the temperature, detected by the first temperature sensor 22, of hot water that is currently discharged. At this time, the controller 16 causes the temperature of hot water to be discharged from the water discharge device 8 to be gradually reduced within the predetermined temperature range T. More specifically, the controller 16 determines the temperature of hot water or water to be stored in the reservoir part 12 that is necessary to reduce the temperature of hot water to be discharged from the water discharge device 8, and causes hot water or water at the determined temperature to be stored in the reservoir part 12 by controlling the high temperature side electromagnetic valve 56 and/or the low temperature side electromagnetic valve 58. In the case where hot water or the like at a certain temperature is stored in the reservoir part 12, the high temperature side electromagnetic valve 56 and/or the low temperature side electromagnetic valve 58 is controlled, and the temperature of hot water or the like in the reservoir part 12 is adjusted. Because the electromagnetic valve 40 is in the open state, the controller 16 drives the second pump 14 and performs supply from the water supply channel 10 to the circulation channel 4. Accordingly, the temperature T2 of hot water in the circulation channel 4 is gradually reduced to a lower temperature due to supply, from the water supply channel 10, of hot water or water at a lower temperature than the temperature T2. The controller 16 gradually changes the temperature of hot water to be discharged from the water discharge device 8 to a lower temperature, and proceeds to step S15.

In the water discharge temperature adjustment mode of the controller 16, hot water or water at a lower temperature than the temperature of hot water in the bathtub main body 2 is supplied from the water supply channel 10 to the circulation channel 4 in such a way that a reduction rate R1 of reduction in the temperature of hot water discharged from the water discharge device 8 in the first stage C1 among the plurality of stages is greater than a reduction rate R2 in the second stage C2. The reduction rate R1 is calculated by (temperature T3−temperature T2)/(reduction time from time t1 to time t2). The time t2 is a time when the temperature of hot water to be discharged from the water discharge device 8 reaches the temperature T2. In the same manner, the reduction rate R2 is calculated by (temperature T2−temperature T4)/(reduction time from time t3 to time t4). Additionally, the reduction rate R2 may be freely set as a value that is smaller than the reduction rate R1. For example, the controller 16 may adjust the temperature of hot water to be discharged, in such a way that the temperature T4 of hot water to be discharged from the water discharge device 8 takes a value near a middle value in the predetermined temperature range T at the time point of the time t4. Additionally, the temperature T4 at the time t4 may be in a lower half on a lower side of the middle value in the predetermined temperature range T or in an upper half on an upper side.

In the water discharge temperature adjustment mode of the controller 16, hot water or water at a lower temperature than the temperature of hot water in the bathtub main body 2 is supplied from the water supply channel 10 to the circulation channel 4 in such a way that the reduction time B1 of reduction in the temperature of hot water to be discharged from the water discharge device 8 in the first stage among the plurality of stages is shorter than the reduction time B2 in the second stage. The reduction time B1 is a reduction time from the time t1 to the time t2, and the reduction time B2 is a reduction time from the time t3 to the time t4.

In step S15, the controller 16 determines whether the temperature of hot water to be discharged from the water discharge device 8 is at or higher than the lower limit temperature T1. In the case where the temperature of hot water to be discharged from the water discharge device 8 is not at or higher than the lower limit temperature T1, the temperature of hot water to be discharged from the water discharge device 8 is reduced more than necessary, and the controller 16 proceeds to S16 to prevent the bathing person from feeling uncomfortable. In the case where the temperature of hot water to be discharged from the water discharge device 8 is at or higher than the lower limit temperature T1, the controller 16 determines that the temperature of hot water to be discharged can continue to be gradually reduced and the bathing person is allowed to keep feeling temperature reduction and a cooling sensation and stimulation based on change in temperature can continue to be provided, and proceeds to "return to subroutine of first water discharge temperature adjustment mode".

In step S16, the controller 16 determines that the temperature of hot water to be discharged from the water discharge device 8 is reduced more than necessary, and that it is necessary to prevent a situation where the bathing person cannot be warmed, and the controller 16 performs control such that supply from the water supply channel 10 to the circulation channel 4 is stopped and water discharge from the water discharge device 8 is performed based only on circulation of hot water in the circulation channel 4, and proceeds to "return to subroutine of first water discharge temperature adjustment mode".

When "return to subroutine of first water discharge temperature adjustment mode" is reached, the controller 16 returns to S5 in FIG. 7, and proceeds to S7 to continue on with following processes.

In step S7, the controller 16 determines whether there is a lapse of a predetermined period of time from the time to to the time t4. The time t4 is set in advance by the controller 16. In the case where an elapsed time from the time to does not exceed the time t4, the controller 16 proceeds to S8. In the case where the elapsed time from the time to exceeds t4, it can be determined that water discharge in the water discharge temperature adjustment mode continued for a certain period of time and that water discharge was sufficiently performed to warm the bathing person from deep inside the body while adjusting the water discharge temperature, and thus, the controller 16 stops the second pump 14 and closes the electromagnetic valve 40 to stop the water discharge temperature adjustment mode, and proceeds to S9.

In step S8, the controller 16 determines whether a stop instruction for the water discharge temperature adjustment mode is received based on an operation input on the remote control 18. In the case where a stop instruction for the water discharge temperature adjustment mode is not received, the controller 16 returns to S3 to keep performing control of water discharge temperature in the water discharge temperature adjustment mode. In the case where a stop instruction for the water discharge temperature adjustment mode is received, it can be determined that the bathing person wants to stop the water discharge temperature adjustment mode, and thus, the controller 16 proceeds to S9.

In step S9, the controller 16 stops the first pump 6, stops water discharge from the water discharge device 8, and proceeds to "end".

In the case of proceeding to "end", the controller 16 ends the series of control processes.

In step S21, the controller 16 determines whether there is a lapse of a predetermined period of time from the time t0 to a time t11. In the case where an elapsed time from the time to does not exceed the time t11, it can be determined that there is no lapse of a predetermined period of time from start of water discharge from the water discharge device 8, and thus, the controller 16 returns to S21 to prevent a drastic temperature change from being applied to the naked bathing person taking a bath. In the case where the elapsed time from the time to exceeds t11, it can be determined that there is a lapse of a predetermined period of time from start of water discharge from the water discharge device 8 and that the naked bathing person taking a bath is getting used to the temperature of hot water that is discharged from the water discharge device 8, and thus, the controller 16 proceeds to S22. During a time when the elapsed time in step S21 is not yet past the time t11, the controller 16 determines the temperature of hot water or water to be stored in the reservoir part 12 that is necessary to increase, in S23 at a later stage, the temperature of hot water to be discharged from the water discharge device 8 from the temperature T5 of hot water in the bathtub main body 2 to the temperature T1, and controls the high temperature side electromagnetic valve 56 and/or the low temperature side electromagnetic valve 58 such that hot water or water at the determined temperature is stored in the reservoir part 12. The controller 16 can estimate, based on output or the rotating speed of the rotating body of the first pump 6, the flow rate of hot water flowing through the circulation channel 4, such as the flow rate of hot water in the injection part side flow channel 4*a* and the water discharge device side flow channel 4*c*. For example, the controller 16 can estimate the flow rate of hot water flowing through the water discharge device side flow channel 4*c*, and acquire the circulation flow rate. The controller 16 can also estimate, based on output or the rotating speed of the rotating body of the second pump 14, an amount of supply of hot water or the like from the water supply channel 10. Accordingly, the controller 16 can determine the temperature of hot water or water in the reservoir part 12 that is necessary to change the temperature of hot water in the circulation channel 4 from T5 to T1 in S23 at a later stage.

In step S22, the controller 16 determines whether a predetermined period of time from the time t0 to time t13 is yet to lapse. In the case where an elapsed time from the time to exceeds the time t13, discharge of hot water at the temperature T1 is already performed from the water discharge device 8 until the time t13, and it can be determined that, after the time t13, control by which the temperature is gradually increased within the predetermined temperature range T and a warming sensation and stimulation based on change in temperature are allowed to be felt is helpful, and the controller 16 proceeds to step S24. In the case the elapsed time from the time to is not yet past the time t13, the temperature of hot water in the bathtub main body is at the temperature T5 that is lower than the lower limit temperature T1 of the predetermined temperature range T, and also, hot water at the temperature T5 is discharged from the water discharge device 8, and thus, it can be determined that it is helpful to increase the temperature of hot water that is poured directly onto the upper body of the bathing person and to warm the bathing person, and the controller 16 proceeds to step S23.

In step S23, the controller 16 causes hot water or water at a temperature that is higher than the temperature T5 of the hot water in the bathtub main body 2 detected by the first temperature sensor 22 to be supplied from the water supply channel 10 to the circulation channel 4, and causes the temperature of hot water to be discharged from the water discharge device 8 to be changed to the temperature T1. During S21, the controller 16 determines the temperature of hot water or water to be stored in the reservoir part 12 that is necessary to increase the temperature of hot water to be discharged from the water discharge device 8 from the temperature T5 of hot water in the bathtub main body 2 to the temperature T1, controls the high temperature side electromagnetic valve 56 and/or the low temperature side electromagnetic valve 58, and causes hot water or water at the determined temperature to be stored in the reservoir part 12. Accordingly, the controller 16 switches the electromagnetic valve 40 from the closed state to the open state, drives the second pump 14, and causes supply to be performed from the water supply channel 10 to the circulation channel 4. The temperature T5 of hot water in the circulation channel 4 is thereby increased to the temperature T1 due to supply of hot water or water, from the water supply channel 10, at a temperature higher than the temperature T5. In this manner, hot water or water at the determined temperature is prepared in the reservoir part 12 in advance while the elapsed time in step S21 is not yet past the time t11, and thus, the controller 16 can increase the temperature of hot water that is discharged from the temperature T5 to the temperature T1 at a relatively early stage in S23.

In the water discharge temperature adjustment mode, the controller 16 causes hot water or water at a temperature higher than the temperature T5 of hot water in the bathtub main body 2 to be supplied from the water supply channel 10 to the circulation channel 4 in such a way that the temperature of hot water to be discharged from the water discharge device 8 is increased, over a plurality of stages, from the temperature of hot water in the bathtub main body 2 to a temperature within the predetermined temperature range T. For example, in a first stage C11 among the plurality of stages, the controller 16 increases the temperature of hot water to be discharged from the water discharge device 8 from the temperature T5 of hot water in the bathtub main body 2 to the temperature T1, and in a second stage C12 among the plurality of stages, the controller 16 increases, as indicated in S24, the temperature of hot water to be discharged from the water discharge device 8 within the predetermined temperature range T. Accordingly, the temperature of hot water that is discharged is increased over the plurality of stages to a temperature within the predetermined temperature range T. Accordingly, compared to a case where the temperature of hot water to be discharged from the water discharge part is increased in one go, the temperature of hot water is increased over the plurality of stages, and the temperature of hot water that is discharged can be increased without placing much burden on the body of the bathing person. After changing the temperature of hot water to be discharged from the water discharge device 8 to the temperature T1, the controller 16 proceeds to "return to subroutine of first water discharge temperature adjustment mode".

For example, from time t12 to the time t13, the controller 16 causes water to be continuously discharged from the water discharge device 8 while keeping the temperature of discharged hot water approximately constant at the temperature T1. In this manner, the water discharge temperature adjustment mode of the controller 16 includes temperature change suppression control that is temperature increase suppression control according to which an increase in temperature between the first stage C11 and the second stage C12 among the plurality of stages is smaller than increase in temperature in either of the first stage C11 and the second stage C12. In the temperature change suppression control, the controller 16 causes water to be continuously discharged from the water discharge device 8 while keeping the temperature of discharged hot water approximately constant at the temperature T2, for example. The temperature change suppression control is performed in a third stage C13 between the first stage C11 and the second stage C12. The temperature change suppression control achieves, in the third stage C13 from the time t12 to the time t13, discharge of water with little or almost no temperature change. The temperature change suppression control is set such that the temperature is changed in the third stage C13 preferably within a range from the upper limit temperature T1+0.5 °C to the upper limit temperature T1−0.5 °C, such as a range from about 38.5 °C to about 37.5 °C. In the water discharge temperature adjustment mode of the controller 16, an execution time B13 of the temperature change suppression control is longer than an increase time B11 in the first stage C11. In the water discharge temperature adjustment mode of the controller 16, the execution time B13 of the temperature change suppression control is shorter than an increase time B12 in the second stage C12.

In step S24, the controller 16 changes the temperature of hot water to be discharged from the water discharge device 8 to be higher than the temperature, detected by the first temperature sensor 22, of hot water that is currently discharged. At this time, the controller 16 causes the temperature of hot water to be discharged from the water discharge device 8 to be gradually increased within the predetermined temperature range T. More specifically, the controller 16 determines the temperature of hot water or water to be stored in the reservoir part 12 that is necessary to increase the temperature of hot water to be discharged from the water discharge device 8, controls the high temperature side electromagnetic valve 56 and/or the low temperature side electromagnetic valve 58, and causes hot water or water at the determined temperature to be stored in the reservoir part 12. In the case where hot water or the like at a certain temperature is stored in the reservoir part 12, the high temperature side electromagnetic valve 56 and/or the low temperature side electromagnetic valve 58 is controlled, and the temperature of hot water or the like in the reservoir part 12 is adjusted. The controller 16 places the electromagnetic valve 40 in the open state, drives the second pump 14, and causes supply to be performed from the water supply channel 10 to the circulation channel 4. Accordingly, the temperature T1 of hot water in the circulation channel 4 is gradually reduced to a higher temperature due to supply of hot water or water at a higher temperature than the temperature T5 from the water supply channel 10. The controller 16 gradually changes the temperature of hot water to be discharged from the water discharge device 8 to a higher temperature, and proceeds to step S25.

In the water discharge temperature adjustment mode of the controller 16, hot water or water at a higher temperature than the temperature of hot water in the bathtub main body 2 is supplied from the water supply channel 10 to the circulation channel 4 in such a way that an increase rate R11 of increase in the temperature of hot water discharged from the water discharge device 8 in the first stage C11 among the plurality of stages is greater than an increase rate R12 in the second stage. The increase rate R11 is calculated by (temperature T1−temperature T5)/(increase time from time t11 to time t12). The time t12 is a time when the temperature of hot water to be discharged from the water discharge device 8 reaches the temperature T1. In the same manner, the increase rate R12 is calculated by (temperature T2−temperature T1)/(increase time from time t13 to time t15). Additionally, the increase rate R12 may be freely set as a value that is smaller than the increase rate R11. For example, at a time point of the time t15, the temperature of hot water to be discharged from the water discharge device 8 is the upper limit temperature T2 of the predetermined temperature range T. Furthermore, for example, at the time point of the time t15, the temperature of hot water to be discharged from the water discharge device 8 may be in the upper half on the upper side of the middle value in the predetermined temperature range T, or may be in the lower half on the lower side.

In the water discharge temperature adjustment mode of the controller 16, hot water or water at a higher temperature than the temperature of hot water in the bathtub main body 2 is supplied from the water supply channel 10 to the circulation channel 4 in such a way that an increase time B11 of increase in the temperature of hot water to be discharged from the water discharge device 8 in the first stage C11 among the plurality of stages is shorter than an increase time B12 in the second stage C12. The increase time B11 is an increase time from the time t11 to the time t12, and the increase time B12 is an increase time from the time t13 to the time t15 (or the time t4).

In step S25, the controller 16 determines whether the temperature of hot water to be discharged from the water discharge device 8 is at or lower than the upper limit temperature T2. In the case where the temperature of hot water to be discharged from the water discharge device 8 is not at or lower than the upper limit temperature T2, the temperature of hot water to be discharged from the water discharge device 8 is increased more than necessary, and the controller 16 proceeds to S26 to prevent the bathing person from feeling uncomfortable. In the case where the temperature of hot water to be discharged from the water discharge device 8 is at or lower than the upper limit temperature T2, the controller 16 determines that the temperature of hot water to be discharged can continue to be gradually increased and the bathing person is allowed to keep feeling temperature increase and a warming sensation and stimulation based on change in temperature can continue to be provided, and proceeds to "return to subroutine of second water discharge temperature adjustment mode".

In step S26, the controller 16 determines that the temperature of hot water to be discharged from the water discharge device 8 is too increased and that it is necessary to prevent the bathing person from feeling uncomfortable, and as shown in FIG. 11, for example, the controller 16 performs control such that supply from the water supply channel 10 to the circulation channel 4 is stopped and water discharge from the water discharge device 8 is performed based on only circulation of hot water in the circulation channel 4, and proceeds to "return to subroutine of second water discharge temperature adjustment mode".

When "return to subroutine of second water discharge temperature adjustment mode" is reached, the controller 16 returns to S6 in FIG. 7, and proceeds to S7 to continue on with following processes.

In the first embodiment of the present invention configured in the above manner, the controller 16 includes the water discharge temperature adjustment mode in which, in the case where the temperature of hot water in the bathtub main body 2 detected by the first temperature sensor 22 is higher than the upper limit temperature T2 of the predetermined temperature range T, water discharge is performed, for a predetermined period of time from reception of a command to start control, from the water discharge device 8 toward the inside of the bathtub main body 2 by circulating hot water that is drawn in from the water intake port part 9*b*, and after a lapse of the predetermined period of time, the temperature of hot water to be discharged from the water discharge device 8 is reduced to within the predetermined temperature range T by the temperature modification part 7. Accordingly, even in a case where a bathing person wants to take a bath with the temperature of hot water in the bathtub main body 2 being at a temperature higher than the upper limit temperature T2 of the predetermined temperature range T that is a recommended temperature zone in which a bathing person can be comfortably warmed, for example, the temperature of hot water that is discharged from the water discharge device 8 and poured directly onto the upper body, such as the neck and shoulders, of the bathing person can be reduced to within the predetermined temperature range T without adjusting the temperature of hot water in the bathtub main body 2 to within the predetermined temperature range T, and thus, the bathing person can be prevented from becoming dizzy, and can be allowed to take a relatively long bath. Furthermore, for a predetermined period of time from start of control in the water discharge temperature adjustment mode, water discharge from the water discharge device 8 is performed by circulating hot water drawn in from the water intake port part 9*b*, and a drastic temperature change may be prevented from being applied to a naked bathing person taking a bath, and thus, a bath can be taken without much burden being placed on the body of the bathing person.

In the first embodiment of the present invention configured in the above manner, in the water discharge temperature adjustment mode, the controller 16 causes the temperature of hot water to be discharged from the water discharge device 8 to be reduced, by the temperature modification part 7, from the temperature of hot water in the bathtub main body 2 to a target temperature within the predetermined temperature range T over a plurality of stages. Accordingly, the temperature of hot water to be discharged from the water discharge device 8 is reduced over a plurality of stages, and the temperature of hot water that is discharged can be reduced without putting much burden on the body of the bathing person. Furthermore, for example, in the case where the temperature modification part 7 includes the water supply channel 10 that is connected to the circulation channel 4 and that is for supplying hot water or water from an external supply source, the controller 16 causes, in the water discharge temperature adjustment mode, hot water or water at a lower temperature than the temperature of hot water in the bathtub main body 2 to be supplied from the water supply channel 10 to the circulation channel 4 in such a way that the temperature of hot water discharged from the water discharge device 8 is reduced, over a plurality of stages, from the temperature of hot water in the bathtub main body 2 to a target temperature within the predetermined temperature range T. Accordingly, the temperature of hot water discharged from the water discharge device 8 is reduced over a plurality of stages, and the temperature of hot water that is discharged can be reduced without placing much burden on the body of the bathing person.

In the first embodiment of the present invention configured in the above manner, in the water discharge temperature adjustment mode of the controller 16, the temperature of hot water to be discharged from the water discharge device 8 is reduced by the temperature modification part 7 in such a way that the reduction rate of reduction in the temperature of hot water discharged from the water discharge device 8 in the first stage C1 among a plurality of stages is greater than the reduction rate in the second stage C2. Accordingly, the temperature of hot water discharged from the water discharge device 8 can be made to approach the predetermined temperature range T relatively quickly in the first stage C1 among a plurality of stages, and the temperature of hot water to be discharged can be made to relatively quickly approach the predetermined temperature range that is the recommended temperature zone in which a bathing person can be comfortably warmed, and then, the temperature of hot water to be discharged can be relatively gradually reduced, and the bathing person is allowed to keep feeling temperature reduction and a cooling sensation and stimulation based on change in temperature can continue to be provided while preventing the bathing person from getting used to the water discharge temperature. Furthermore, for example, in the case where the temperature modification part 7 includes the water supply channel 10 that is connected to the circulation channel 4 and that is for supplying hot water or water from an external supply source, hot water or water at a lower temperature than the temperature of hot water in the bathtub main body 2 is supplied, in the water discharge temperature adjustment mode of the controller 16, from the water supply channel 10 to the circulation channel 4 in such a way that the reduction rate of reduction in the temperature of hot water discharged from the water discharge device 8 in the first stage C1 among a plurality of stages is greater than the reduction rate in the second stage C2. Accordingly, the temperature of hot water discharged from the water discharge device 8 can be made to approach the predetermined temperature range T relatively quickly in the first stage C1 among a plurality of stages, and the temperature of hot water to be discharged can be made to relatively quickly approach the predetermined temperature range that is the recommended temperature zone in which a bathing person can be comfortably warmed, and then, the temperature of hot water to be discharged can be relatively gradually reduced, and the bathing person is allowed to keep feeling temperature reduction and a cooling sensation and stimulation based on change in temperature can continue to be provided while preventing the bathing person from getting used to the water discharge temperature.

In the first embodiment of the present invention configured in the above manner, in the water discharge temperature adjustment mode of the controller 16, the temperature of hot water to be discharged from the water discharge device 8 is reduced by the temperature modification part 7 in such a way that the reduction time B1 of reduction in the temperature of hot water to be discharged from the water discharge device 8 in the first stage C1 among the plurality of stages is shorter than the reduction time B2 in the second stage C2. Accordingly, the temperature of hot water to be discharged from the water discharge device 8 can be made to approach the predetermined temperature range T in a relatively short time in the first stage C1 among a plurality of stages, and the temperature of hot water to be discharged can be made to relatively quickly approach the predetermined temperature range that is the recommended temperature zone in which a bathing person can be comfortably warmed, and then, the temperature of hot water to be discharged can be reduced over a relatively long time, and the bathing person is allowed to keep feeling temperature reduction and a cooling sensation and stimulation based on change in temperature can continue to be provided while preventing the bathing person from getting used to the water discharge temperature. Furthermore, by making the time when a temperature change is applied to the naked bathing person taking a bath relatively short in the first stage C1 at the beginning, and then, making the time when a temperature change is applied to the bathing person longer in the next second stage C2, the temperature of hot water that is discharged may be reduced without placing much burden on the body of the bathing person. Furthermore, for example, in the case where the temperature modification part 7 includes the water supply channel 10 that is connected to the circulation channel 4 and that is for supplying hot water or water from an external supply source, in the water discharge temperature adjustment mode of the controller 16, the temperature of hot water to be discharged from the water discharge device 8 is reduced in such a way that the reduction time B1 of reduction in the temperature of hot water to be discharged from the water discharge device 8 in the first stage C1 among the plurality of stages is shorter than the reduction time B2 in the second stage C2. Accordingly, the temperature of hot water to be discharged from the water discharge device 8 can be made to approach the predetermined temperature range T in a relatively short time in the first stage C1 among a plurality of stages, and the temperature of hot water to be discharged can be made to relatively quickly approach the predetermined temperature range that is the recommended temperature zone in which a bathing person can be comfortably warmed, and then, the temperature of hot water to be discharged can be reduced over a relatively long time, and the bathing person is allowed to keep feeling temperature reduction and a cooling sensation and stimulation based on change in temperature can continue to be provided while preventing the bathing person from getting used to the water discharge temperature. Furthermore, by making the time when a temperature change is applied to the naked bathing person taking a bath relatively short in the first stage C1 at the beginning, and then, making the time when a temperature change is applied to the bathing person longer in the next second stage C2, the temperature of hot water that is discharged may be reduced without placing much burden on the body of the bathing person.

In the first embodiment of the present invention configured in the above manner, the water discharge temperature adjustment mode of the controller 16 includes temperature change suppression control according to which a reduction in the temperature is smaller between the first stage C1 and the second stage C2 among the plurality of stages than in either of the first stage C1 and the second stage C2. Accordingly, after the temperature of hot water to be discharged from the water discharge device 8 is reduced in the first stage C1, the bathing person is provided with an opportunity to get used to the water discharge temperature that is reduced, and it is possible to prevent much burden from being placed on the body of the bathing person. Moreover, because the temperature of hot water to be discharged is reduced in the second stage C2 after the body of the bathing person gets used to the water discharge temperature that is reduced in the first stage C, even less burden is placed on the body of the bathing person.

In the first embodiment of the present invention configured in the above manner, in the water discharge temperature adjustment mode of the controller 16, the execution time B3 of the temperature change suppression control is longer than the reduction time B1 in the first stage C1. Accordingly, a longer time can be secured as the execution time of the temperature change suppression control for allowing the bathing person to get used to the water discharge temperature that is reduced, and even less burden is placed on the body of the bathing person.

In the first embodiment of the present invention configured in the above manner, in the water discharge temperature adjustment mode of the controller 16, the execution time B3 of the temperature change suppression control is shorter than the reduction time B2 in the second stage C2. Accordingly, by making the reduction time B2 in the second stage C2 longer while securing the execution time of the temperature change suppression control for allowing the bathing person to get used to the water discharge temperature that is reduced, the temperature of hot water to be discharged can be reduced without placing much burden on the body of the bathing person.

In the first embodiment of the present invention configured in the above manner, the controller 16 includes the water discharge temperature adjustment mode in which, in the case where the temperature of hot water in the bathtub main body 2 detected by the first temperature sensor 22 is higher than the upper limit temperature T2 of the predetermined temperature range T, water discharge is performed, for a predetermined period of time from reception of a command to start control, from the water discharge device 8 toward the inside of the bathtub main body 2 by circulating hot water that is drawn in from the water intake port part 9*b*, and after a lapse of the predetermined period of time, the temperature of hot water to be discharged from the water discharge device 8 is reduced to within the predetermined temperature range T by supplying, from the water supply channel 10 to the circulation channel 4, water or hot water at a lower temperature than the temperature, detected by the first temperature sensor 22, of hot water in the bathtub main body 2. Accordingly, even in a case where a bathing person wants to take a bath with the temperature of hot water in the bathtub main body 2 being at a temperature higher than the upper limit temperature T2 of the predetermined temperature range T that is often found desirable by a bathing person, for example, the temperature of hot water that is discharged from the water discharge device 8 and that is poured directly onto the upper body, such as the neck and shoulders, of the bathing person can be reduced to within the predetermined temperature range T and the bathing person can be prevented from becoming dizzy even without adjusting the temperature of hot water in the bathtub main body 2 to within the predetermined temperature range T, and a relatively long bath can be taken. Moreover, for a predetermined period of time from start of control in the water discharge temperature adjustment mode, water discharge from the water discharge device 8 can be performed by circulating hot water that is drawn in from the water intake port part 9*b*, and a drastic temperature change can be prevented from being applied to the naked bathing person taking a bath, and the bathing person is allowed to take a bath without much burden being placed on the body of the bathing person.

In the first embodiment of the present invention configured in the above manner, the controller 16 includes the water discharge temperature adjustment mode in which, in the case where the temperature of hot water in the bathtub main body 2 detected by the first temperature sensor 22 is lower than the lower limit temperature T5 of the predetermined temperature range T, water discharge is performed, for a predetermined period of time from reception of a command to start control, from the water discharge device 8 toward the inside of the bathtub main body 2 by circulating hot water that is drawn in from the water intake port part 9*b*, and after a lapse of the predetermined period of time, the temperature of hot water to be discharged from the water discharge device 8 is increased to within the predetermined temperature range T by the temperature modification part 7. Accordingly, in the case where the bathing person wants to take a bath at a lower temperature than the lower limit temperature T5 of the predetermined temperature range T, for example, a bathing temperature that is comfortable to the bathing person can be maintained by keeping the temperature of hot water in the bathtub main body 2 at a relatively low temperature while increasing the temperature of hot water that is discharged from the water discharge device 8 and poured directly onto the upper body, such as the neck and the shoulders, of the bathing person to within the predetermined temperature range T, and the bathing person can thereby be partially warmed. The bathing person can thereby take a bath at a comfortable bathing temperature while being warmed by water discharge that does not place much burden on the body of the bathing person. Moreover, for a predetermined period of time from start of control in the water discharge temperature adjustment mode, water discharge is performed from the water discharge device by circulating hot water that is drawn in from the water intake port part 9*b*, and a drastic temperature change is prevented from being applied to the naked bathing person taking a bath, and the bathing person is allowed to take a bath without much burden being placed on the body of the bathing person.

In the first embodiment of the present invention configured in the above manner, in the water discharge temperature adjustment mode, the controller 16 causes, by the temperature modification part 7, the temperature of hot water to be discharged from the water discharge device 8 to be reduced from the temperature of hot water in the bathtub main body 2 to a target temperature within the predetermined temperature range T over a plurality of stages. Accordingly, the temperature of hot water to be discharged from the water discharge device 8 can be reduced over a plurality of stages, and the temperature of hot water to be discharged can be reduced without placing much burden on the body of the bathing person. Furthermore, for example, in the case where the temperature modification part 7 includes the water supply channel 10 that is connected to the circulation channel 4 and that is for supplying hot water or water from an external supply source, the controller 16 causes, in the water discharge temperature adjustment mode, hot water or water at a lower temperature than the temperature of hot water in the bathtub main body 2 to be supplied from the water supply channel 10 to the circulation channel 4 in such a way that the temperature of hot water to be discharged from the water discharge device 8 is reduced from the temperature of hot water in the bathtub main body 2 to a target temperature within the predetermined temperature range T over a plurality of stages. Accordingly, the temperature of hot water to be discharged from the water discharge device 8 can be reduced over a plurality of stages, and the temperature of hot water to be discharged can be reduced without placing much burden on the body of the bathing person.

In the first embodiment of the present invention configured in the above manner, in the water discharge temperature adjustment mode of the controller 16, the temperature of hot water to be discharged from the water discharge device 8 is increased, by the temperature modification part 7, in such a way that the increase rate of increase in the temperature of hot water to be discharged from the water discharge device 8 in the first stage among a plurality of stages is greater than the increase rate in the second stage. Accordingly, the temperature of hot water to be discharged from the water discharge device 8 can be made to approach the predetermined temperature range T relatively quickly in the first stage C1 among a plurality of stages, and the temperature of hot water to be discharged can be made to relatively quickly approach the predetermined temperature range that feels comfortable to the bathing person, and then, the temperature of hot water to be discharged can be relatively gradually increased, and the bathing person is allowed to keep feeling temperature increase and a warming sensation and stimulation based on change in temperature can continue to be provided while preventing the bathing person from getting used to the water discharge temperature. Furthermore, for example, in the case where the temperature modification part 7 includes the water supply channel 10 that is connected to the circulation channel 4 and that is for supplying hot water or water from an external supply source, the temperature of hot water to be discharged from the water discharge part is increased in the water discharge temperature adjustment mode of the controller 16 in such a way that the increase rate of increase in the temperature of hot water to be discharged from the water discharge device 8 in the first stage among a plurality of stages is greater than the increase rate in the second stage. Accordingly, the temperature of hot water to be discharged from the water discharge device 8 can be made to approach the predetermined temperature range T relatively quickly in the first stage C1 among a plurality of stages, and the temperature of hot water to be discharged can be made to relatively quickly approach the predetermined temperature range that is the recommended temperature zone in which a bathing person can be comfortably warmed, and then, the temperature of hot water to be discharged can be relatively gradually increased, and the bathing person is allowed to keep feeling temperature increase and a warming sensation and stimulation based on change in temperature can continue to be provided while preventing the bathing person from getting used to the water discharge temperature.

In the first embodiment of the present invention configured in the above manner, in the water discharge temperature adjustment mode of the controller 16, the temperature of hot water to be discharged from the water discharge device 8 is increased, by the temperature modification part 7, in such a way that an increase time of increase in the temperature of hot water to be discharged from the water discharge device 8 in the first stage among the plurality of stages is shorter than the increase time in the second stage. Accordingly, the temperature of hot water to be discharged from the water discharge device 8 can be made to approach the predetermined temperature range in a relatively short time in the first stage among a plurality of stages, and the temperature of hot water to be discharged can be made to relatively quickly approach the predetermined temperature range that feels comfortable to the bathing person, and then, the temperature of hot water to be discharged can be relatively gradually reduced, and the bathing person is allowed to keep feeling temperature increase and a warming sensation and stimulation based on change in temperature can continue to be provided while preventing the bathing person from getting used to the water discharge temperature that is increased. Furthermore, by making the time when a temperature change is applied to the naked bathing person taking a bath relatively short in the first stage at the beginning, and then, making the time when a temperature change is applied to the bathing person longer in the next second stage, the temperature of hot water that is discharged may be increased without placing much burden on the body of the bathing person. Furthermore, for example, in the case where the temperature modification part 7 includes the water supply channel 10 that is connected to the circulation channel 4 and that is for supplying hot water or water from an external supply source, the temperature of hot water to be discharged from the water discharge part 8 is increased in the water discharge temperature adjustment mode of the controller 16 in such a way that the increase time of increase in the temperature of hot water to be discharged from the water discharge device 8 in the first stage among a plurality of stages is shorter than the increase time in the second stage. Accordingly, the temperature of hot water to be discharged from the water discharge device 8 can be made to approach the predetermined temperature range in a relatively short time in the first stage among a plurality of stages, and the temperature of hot water to be discharged can be made to relatively quickly approach the predetermined temperature range that is the recommended temperature zone in which a bathing person can be comfortably warmed, and then, the temperature of hot water to be discharged can be relatively gradually reduced, and the bathing person is allowed to keep feeling temperature increase and a warming sensation and stimulation based on change in temperature can continue to be provided while preventing the bathing person from getting used to the water discharge temperature that is increased. Furthermore, by making the time when a temperature change is applied to the naked bathing person taking a bath relatively short in the first stage at the beginning, and then, making the time when a temperature change is applied to the bathing person longer in the next second stage, the temperature of hot water that is discharged may be increased without placing much burden on the body of the bathing person.

In the first embodiment of the present invention configured in the above manner, the water discharge temperature adjustment mode of the controller 16 includes temperature change suppression control according to which an increase in the temperature is smaller between the first stage and the second stage among the plurality of stages than in either of the first stage and the second stage. Accordingly, after the temperature of hot water to be discharged from the water discharge device 8 is increased in the first stage, the bathing person is provided with an opportunity to get used to the water discharge temperature that is increased, and it is possible to prevent much burden from being placed on the body of the bathing person. Moreover, because the temperature of hot water to be discharged is increased in the second stage after the body of the bathing person gets used to the water discharge temperature that is increased in the first stage, even less burden is placed on the body of the bathing person.

In the first embodiment of the present invention configured in the above manner, in the water discharge temperature adjustment mode of the controller 16, the execution time of the temperature change suppression control is longer than the increase time in the first stage. Accordingly, the execution time of the temperature change suppression control when the temperature change is relatively small can be made longer, and even less burden is placed on the body of the bathing person.

In the first embodiment of the present invention configured in the above manner, in the water discharge temperature adjustment mode of the controller 16, the execution time of the temperature change suppression control is shorter than the increase time in the second stage. Accordingly, by making the increase time in the second stage longer while securing the execution time of the temperature change suppression control for allowing the bathing person to get used to the water discharge temperature that is increased, the temperature of hot water that is discharged can be increased without placing much burden on the body of the bathing person.

In the first embodiment of the present invention configured in the above manner, the controller 16 includes the water discharge temperature adjustment mode in which, in the case where the temperature of hot water in the bathtub main body 2 detected by the first temperature sensor 22 is lower than the lower limit temperature T5 of the predetermined temperature range T, water discharge is performed, for a predetermined period of time from reception of a command to start control, from the water discharge device 8 toward the inside of the bathtub main body 2 by circulating hot water that is drawn in from the water intake port part 9*b*, and after a lapse of the predetermined period of time, hot water or water at a higher temperature than the temperature of hot water in the bathtub main body 2 detected by the first temperature sensor 22 is supplied from the water supply channel 10 to the circulation channel 4, and the temperature of hot water to be discharged from the water discharge device 8 is increased to within the predetermined temperature range T. Accordingly, in the case where the bathing person wants to take a bath at a lower temperature than the lower limit temperature T5 of the predetermined temperature range T, for example, a bathing temperature that is comfortable to the bathing person can be maintained by keeping the temperature of hot water in the bathtub main body 2 at a relatively low temperature while increasing the temperature of hot water that is discharged from the water discharge device 8 and poured directly onto the upper body, such as the neck and the shoulders, of the bathing person to within the predetermined temperature range T, and the bathing person can thereby be partially warmed. The bathing person can thereby take a bath at a comfortable bathing temperature while being warmed by water discharge that does not place much burden on the body of the bathing person.

Next, a bathtub device according to a second embodiment of the present invention will be described with reference to FIG. 12 to FIG. 17.

A water discharge device of the present embodiment is different from the first embodiment described above in that adjustment of a temperature of hot water that is to be discharged is started immediately after water discharge from a water discharge part is started and with respect to a configuration for performing temperature adjustment. Accordingly, in the following, only aspects of the second embodiment of the present invention different from those in the first embodiment will be described, and description of same configurations, operations, and effects will be omitted.

Figure 12:
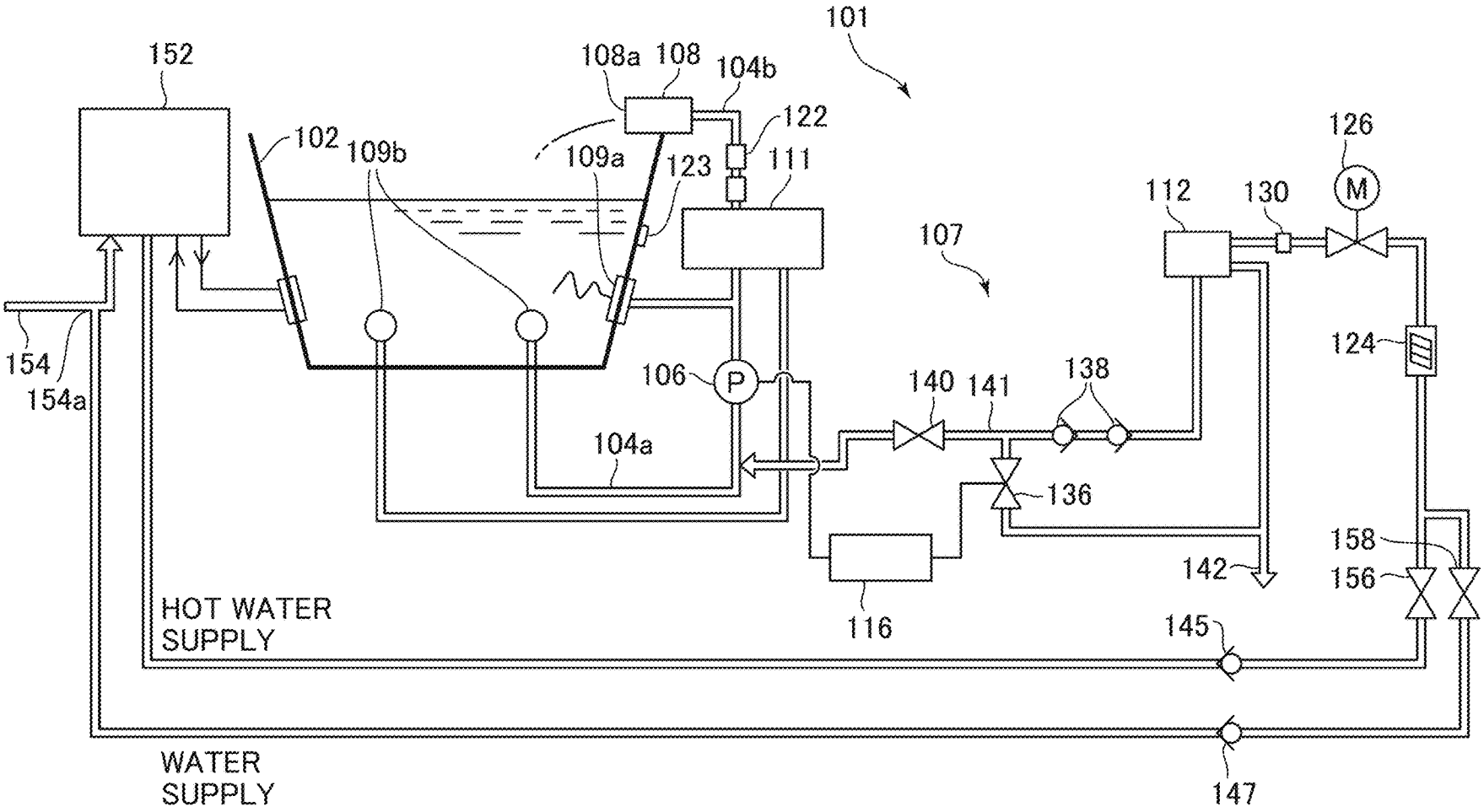
FIG. 12 is a diagram showing a supply system for hot water of a bathtub device according to a second embodiment of the present invention.
Figure 13:
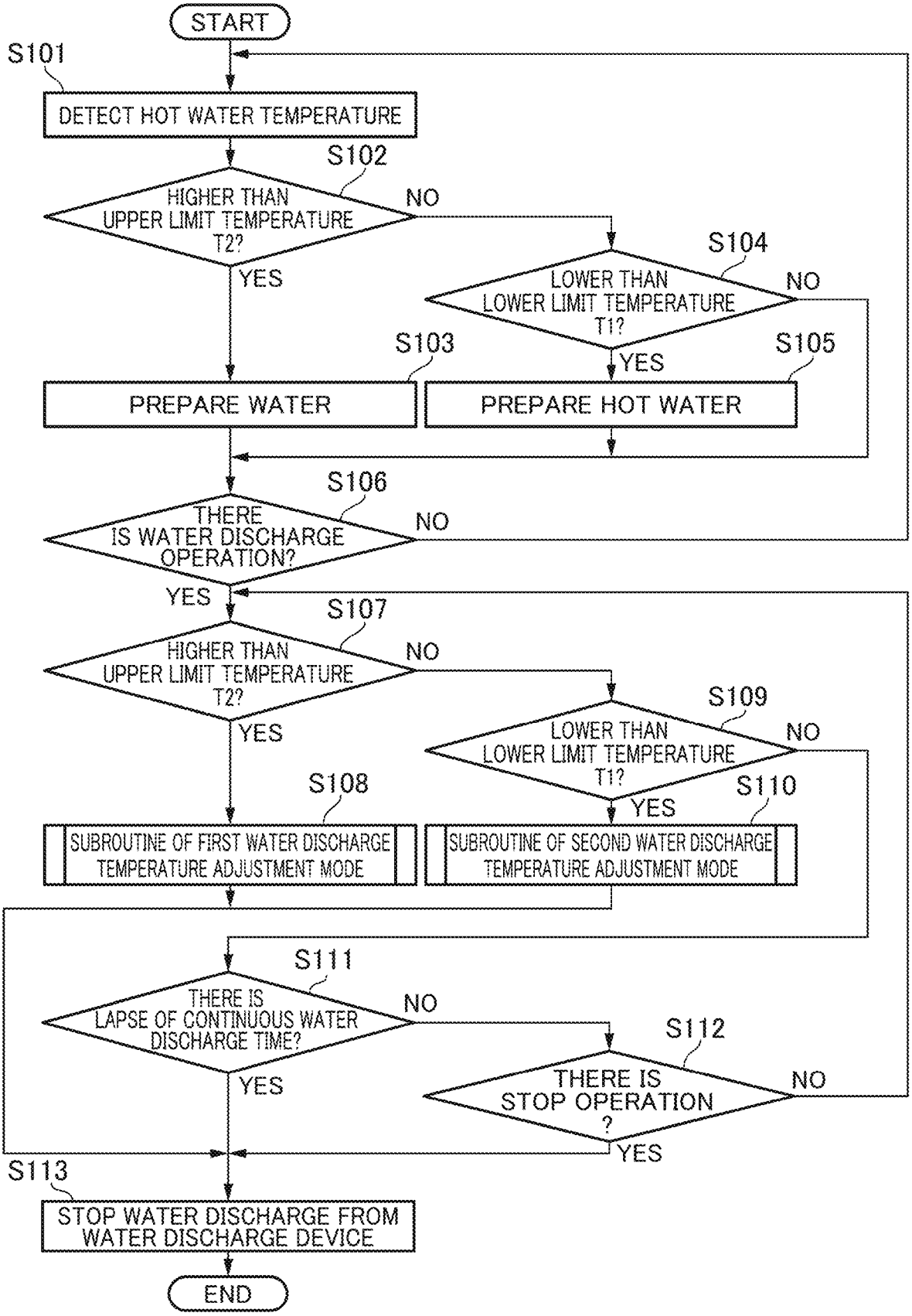
FIG. 13 is a flowchart showing an operation of the bathtub device according to the second embodiment of the present invention.
Figure 14:
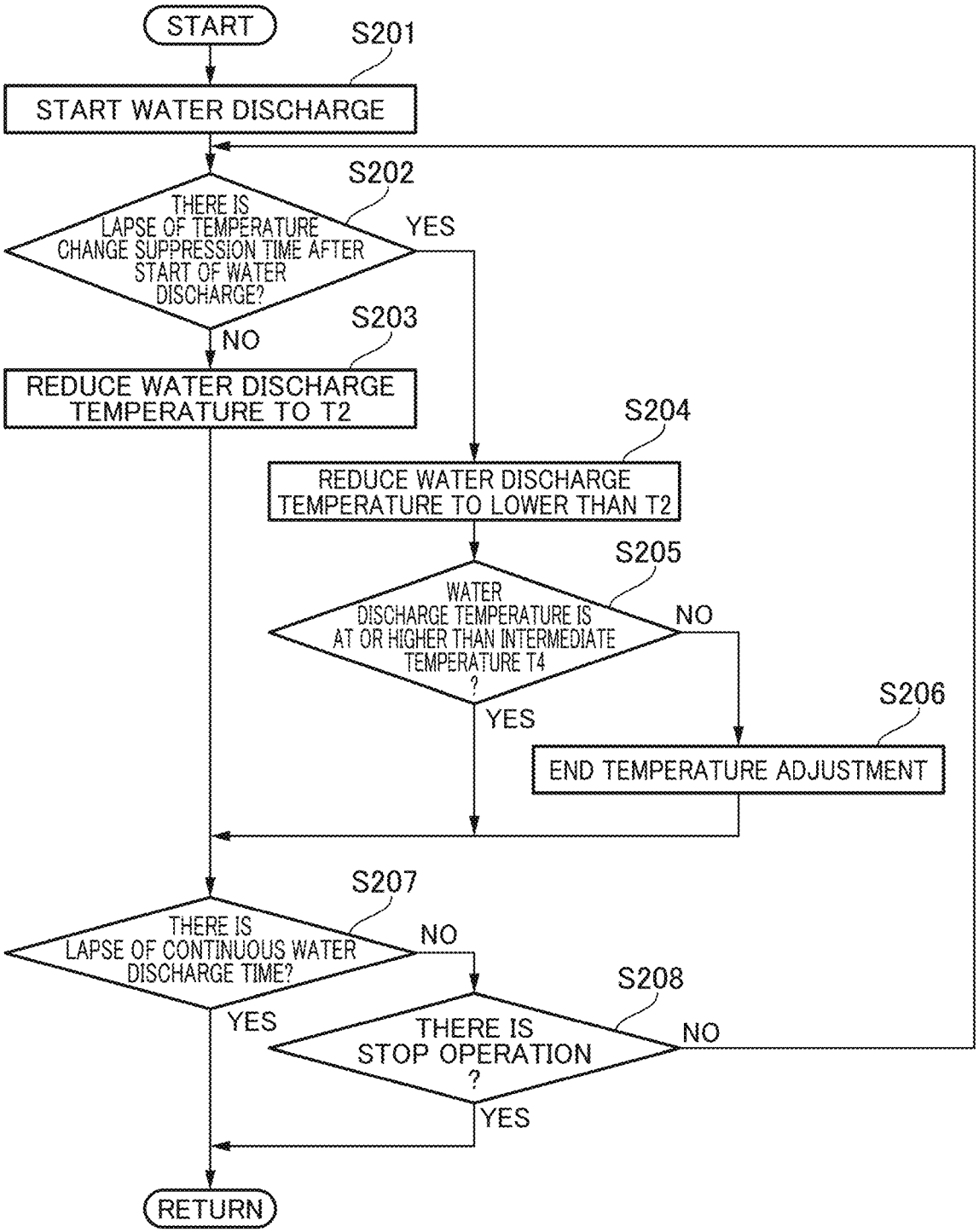
FIG. 14 is a subroutine according to the second embodiment of the present invention that is invoked from the flowchart shown in FIG. 13, and is a flowchart showing a process in the first water discharge temperature adjustment mode.
Figure 15:
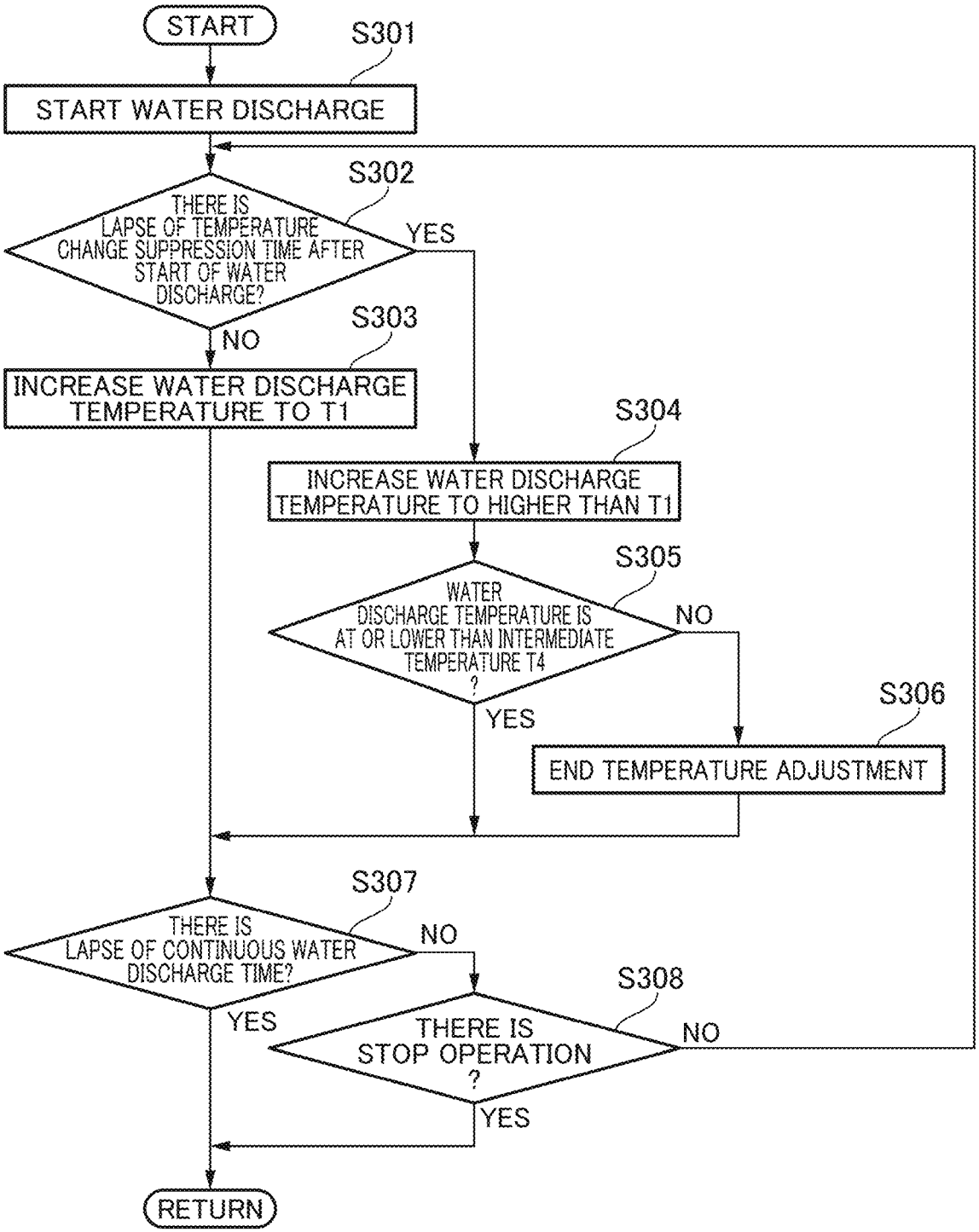
FIG. 15 is a subroutine according to the second embodiment of the present invention that is invoked from the flowchart shown in FIG. 13, and is a flowchart showing a process in the second water discharge temperature adjustment mode.
Figure 16:
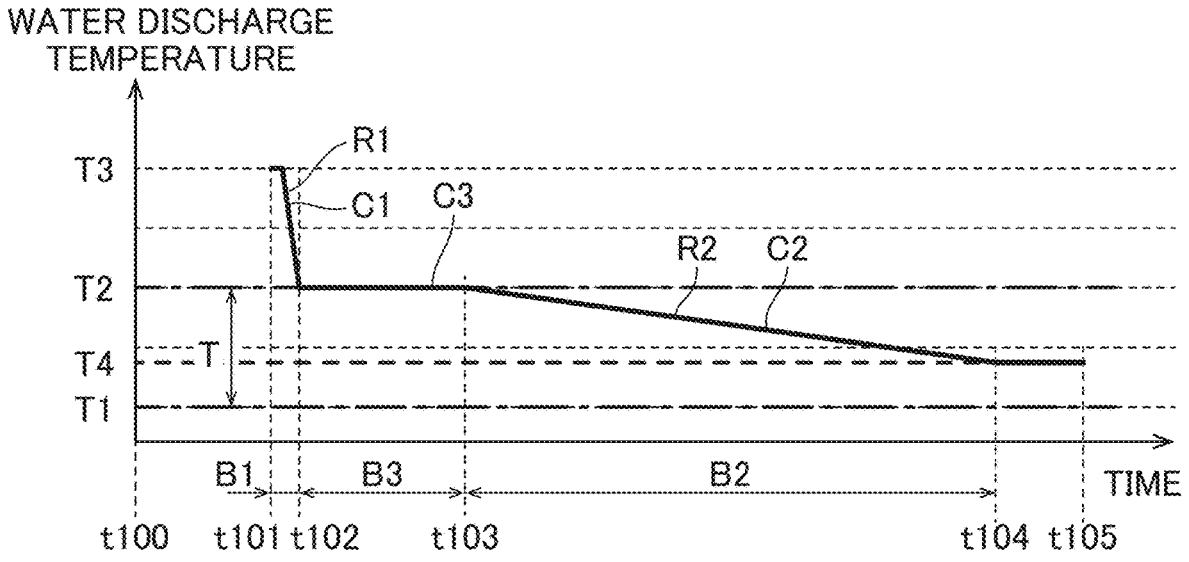
FIG. 16 is a time chart showing a change in temperature of hot water that is discharged from a water discharge part in a case where the first water discharge temperature adjustment mode is performed by the bathtub device according to the second embodiment of the present invention.
Figure 17:
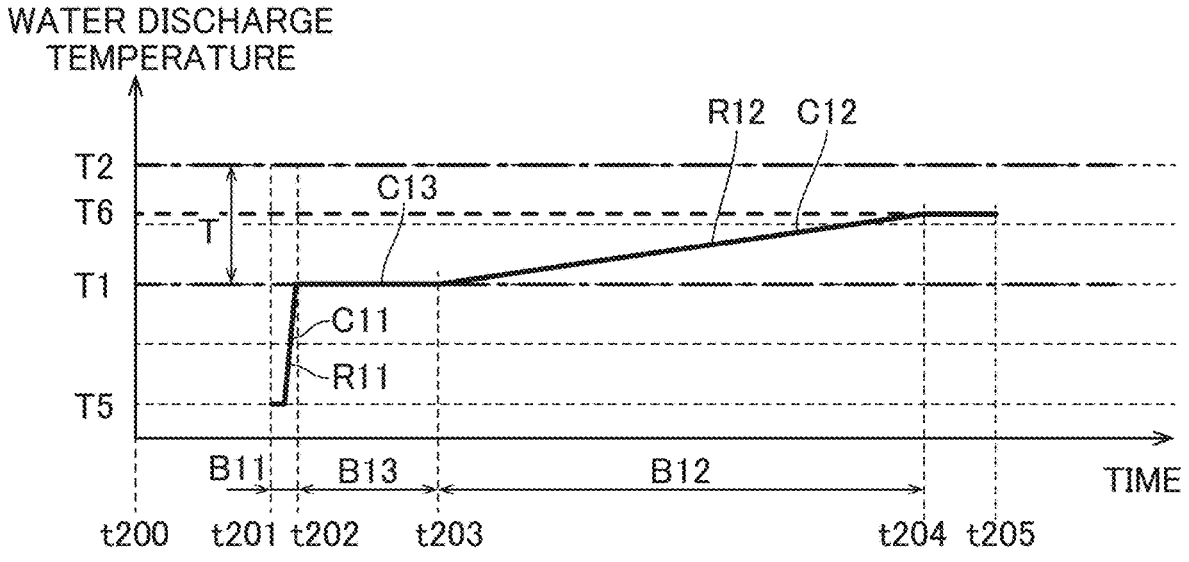
FIG. 17 is a time chart showing a change in temperature of hot water that is discharged from the water discharge part in a case where the second water discharge temperature adjustment mode is performed by the bathtub device according to the second embodiment of the present invention.

FIG. 12 is a diagram showing a supply system for hot water of a bathtub device according to the second embodiment of the present invention. FIG. 13 is a flowchart showing an operation of the bathtub device according to the second embodiment of the present invention. FIG. 14 is a subroutine that is invoked from the flowchart shown in FIG. 13, and is a flowchart showing a process in the first water discharge temperature adjustment mode. FIG. 15 is a subroutine that is invoked from the flowchart shown in FIG. 13, and is a flowchart showing a process in the second water discharge temperature adjustment mode. FIG. 16 is a time chart showing a change in temperature of hot water that is discharged from a water discharge part in a case where the first water discharge temperature adjustment mode is performed by the bathtub device according to the second embodiment of the present invention. FIG. 17 is a time chart showing a change in temperature of hot water that is discharged from the water discharge part in a case where the second water discharge temperature adjustment mode is performed by the bathtub device according to the second embodiment of the present invention.

As shown in FIG. 12, a bathtub device 101 according to the second embodiment of the present invention includes a bathtub main body 102, a bathtub water discharge port 109*a* provided in the bathtub main body 102, a water intake port part 109*b*, a water discharge device 108, and a circulation pump 106. The bathtub device 101 of the present embodiment causes hot water in the bathtub main body 102 that is drawn in from the water intake port part 109*b* to be circulated by the circulation pump 106 and to be discharged from the bathtub water discharge port 109*a* and a water discharge part 108*a* of the water discharge device 108. That is, hot water in the bathtub main body 102 is drawn in from the water intake port part 109*b* by the circulation pump 106, and is discharged from the water discharge part 108*a* through a first conduit 104*a*, a chamber 111 and a second conduit 104*b* as a circulation channel. Moreover, a temperature of hot water to be discharged from the water discharge part 108*a* is detected by a water discharge temperature sensor 122 provided on a downstream side of the chamber 111, and a temperature of hot water in the bathtub main body 102 is detected by a bathtub water temperature sensor 123 as a sensing unit.

Furthermore, the bathtub device 101 of the present embodiment includes a temperature modification part 107 for adjusting a temperature of hot water that is to be discharged from the water discharge part 108*a*. In the present embodiment, the temperature modification part 107 includes an injection valve 140 for mixing hot water at a desired temperature into the circulation channel, a supply channel 141 connected on an upstream side of the injection valve 140, and a controller 116 for controlling the injection valve 140. Furthermore, two check valves 138 and a vacuum breaker 112 are connected on an upstream side of the supply channel 141. Moreover, the supply channel 141 is connected to the first conduit 104*a* on an upstream side of the circulation pump 106, and may cause water or hot water at a predetermined temperature inside the supply channel 141 to be mixed inside the circulation channel by opening the injection valve 140.

Moreover, a water discharge electromagnetic valve 136 for draining hot water retained in the supply channel 141 is connected to the supply channel 141, and the water discharge electromagnetic valve 136 is opened/closed by a control signal from the controller 116. Hot water in the supply channel 141 that is drained via the water discharge electromagnetic valve 136 is discharged to a discharge passage 142. Hot water flowing backward from the supply channel 141 to the vacuum breaker 112 is also discharged from the vacuum breaker 112 to the discharge passage 142. The supply channel 141 and an upstream side of the vacuum breaker 112 are thus cut off, and backflow of hot water from the supply channel 141 to the supply system is prevented.

Next, the supply system for hot water on the upstream side of the vacuum breaker 112 will be described.

Water supplied from waterworks 154 flows into a low temperature side electromagnetic valve 158 via a check valve 147. A part of water supplied from the waterworks 154 is branched off at a branching portion 154*a* to flow into a water heater 152. Hot water heated at the water heater 152 flows into a high temperature side electromagnetic valve 156. Water and hot water flowing into the low temperature side electromagnetic valve 158 and the high temperature side electromagnetic valve 156 are merged on a downstream side thereof, and mixed hot water flows into a water amount sensor 124. Moreover, hot water flowing into the water amount sensor 124 flows into the vacuum breaker 112 via a water amount proportional valve 126 and an inflow side thermistor 130.

Detection signals about a flow rate detected by the water amount sensor 124 and a temperature detected by the inflow side thermistor 130 are input to the controller 116. The controller 116 is able to cause hot water to flow into the supply channel 141 via the vacuum breaker 112 at a desired temperature and at a desired flow rate by controlling the low temperature side electromagnetic valve 158, the high temperature side electromagnetic valve 156, and the water amount proportional valve 126 based on the detection signals.

Next, an operation of the bathtub device 101 according to the second embodiment of the present invention will be described with reference to FIG. 13 to FIG. 16.

A flowchart shown in FIG. 13 shows processes that are performed by the controller 116 after the bathtub main body 102 is filled with hot water.

First, in step S101 in FIG. 13, a temperature of hot water that is stored in the bathtub main body 102 and detected by the bathtub water temperature sensor 123 is input to the controller 116.

Next, in step S102, whether the temperature of hot water that is input is higher than the upper limit temperature T2 of the predetermined temperature range T is determined. In the case where the temperature of hot water is higher than the upper limit temperature T2, step S103 is performed next, and in the case where the temperature is at or lower than the upper limit temperature T2, step S104 is performed next. In the example shown in FIG. 16, at a time t100 when filling of the bathtub main body 102 with hot water is completed, the temperature of hot water in the bathtub main body 102 is an initial temperature T3 that is higher than the upper limit temperature T2, and thus, the process in the flowchart proceeds to step S103.

In step S103, water to be mixed with the hot water that is to be discharged from the water discharge part 108*a* of the water discharge device 108 is prepared. More specifically, the controller 116 transmits a control signal to the water discharge electromagnetic valve 136, and opens the water discharge electromagnetic valve 136. Hot water retained in the supply channel 141 on the upstream side of the injection valve 140 is thus drained through the discharge passage 142. Next, the controller 116 transmits a control signal to the low temperature side electromagnetic valve 158, and opens the low temperature side electromagnetic valve 158. Water supplied from the waterworks 154 thus flows into the supply channel 141 through the check valve 147, the low temperature side electromagnetic valve 158, the water amount sensor 124, the water amount proportional valve 126, the inflow side thermistor 130, and the vacuum breaker 112. When tap water flowing in through the vacuum breaker 112 fills the supply channel 141, the controller 116 closes the water discharge electromagnetic valve 136. Additionally, the temperature of hot water that is introduced through the vacuum breaker 112 is not sufficiently low immediately after opening of the low temperature side electromagnetic valve 158, and thus, the controller 116 closes the water discharge electromagnetic valve 136 after the temperature that is detected by the inflow side thermistor 130 falls to a predetermined temperature lower than the lower limit temperature T1.

In the case where the temperature of hot water in the bathtub main body 102 is at or lower than the upper limit temperature T2 in step S102, the process in the flowchart proceeds to step S104.

In step S104, whether the temperature of hot water input in step S101 is lower than the lower limit temperature T1 of the predetermined temperature range T is determined. In the case where the temperature of hot water is lower than the lower limit temperature T1, step S105 is performed next, and in the case where the temperature is at or higher than the lower limit temperature T1, step S106 is performed next.

In step S105, hot water at a high temperature is prepared to be mixed into hot water that is to be discharged from the water discharge part 108*a* of the water discharge device 108. More specifically, the controller 116 transmits a control signal to the water discharge electromagnetic valve 136, and opens the water discharge electromagnetic valve 136. Hot water retained in the supply channel 141 on the upstream side of the injection valve 140 is thereby drained through the discharge passage 142. Next, the controller 116 transmits a control signal to the high temperature side electromagnetic valve 156, and opens the high temperature side electromagnetic valve 156. Hot water at a high temperature flowing from the water heater 152 thereby flows into the supply channel 141 through the check valve 145, the high temperature side electromagnetic valve 156, the water amount sensor 124, the water amount proportional valve 126, the inflow side thermistor 130, and the vacuum breaker 112.

When hot water at a high temperature flowing in through the vacuum breaker 112 fills the supply channel 141, the controller 116 closes the water discharge electromagnetic valve 136. Additionally, the temperature of hot water that is introduced through the vacuum breaker 112 is not sufficiently high immediately after the water heater 152 is ignited, and thus, the controller 116 closes the water discharge electromagnetic valve 136 after the temperature detected by the inflow side thermistor 130 is increased to a predetermined temperature higher than the lower limit temperature T1.

Next, in step S106, whether an operation for starting water discharge from the water discharge device 108 is performed by the bathing person is determined. In the case where a water discharge start operation is performed by the bathing person, step S107 is performed next, and in the case where the water discharge start operation is not performed, step S101 is performed next. Accordingly, processes from steps S101 to S106 are repeatedly performed after filling of the bathtub main body 102 with hot water is completed and until the water discharge start operation is performed by the bathing person. Additionally, once the processes in steps S103 and S105 are performed, the processes are not performed again until a lapse of a predetermined period of time. This is because the temperature of water or hot water filling the supply channel 141 is maintained approximately the same for a certain period of time.

When the water discharge start operation is performed by the bathing person, an instruction signal for starting water discharge is transmitted to the controller 116, and the process in the flowchart proceeds to step S107.

In step S107, whether the temperature of hot water in the bathtub main body 102 is higher than the upper limit temperature T2 is determined, and in the case where the temperature is higher than the upper limit temperature T2, step S108 is performed next, and in the case where the temperature is at or lower than the upper limit temperature T2, step S109 is performed next. In the example shown in FIG. 16, the water discharge start operation is performed by the bathing person at a time t101, and because the temperature of hot water in the bathtub main body 102 is higher than the upper limit temperature T2 at the time point, the process in the flowchart proceeds to step S108.

In step S108, a subroutine shown in FIG. 14 is performed. That is, first temperature adjustment control for reducing the water discharge temperature to lower than the upper limit temperature T2 is performed by the subroutine shown in FIG. 14.

In step S201 in FIG. 14, water discharge from the water discharge part 108*a* of the water discharge device 108 is started by the controller 116. More specifically, the controller 116 transmits a control signal to the circulation pump 106, and activates the circulation pump 106. Hot water in the bathtub main body 102 is thereby drawn in from the water intake port part 109*b*, and is discharged from the water discharge part 108*a* after flowing through the first conduit 104*a*, the chamber 111, and the second conduit 104*b* as the circulation channel. At the same time, the controller 116 opens the injection valve 140, and causes tap water supplied form the supply channel 141 to be mixed in the circulation channel (the first conduit 104*a*). In step S103 (FIG. 13), the supply channel 141 is filled with tap water, and thus, tap water at a lower temperature can be mixed in the first conduit 104*a* from the start.

Next, in step S202, whether there is a lapse of a predetermined temperature change suppression time after start of water discharge at the time t101 is determined. In the case where there is no lapse of the predetermined temperature change suppression time, step S203 is performed next, and in the case where there is a lapse of the temperature change suppression time, step S204 is performed next.

In step S203, temperature adjustment control is performed by the controller 116 such that the temperature of hot water to be discharged from the water discharge device 108 reaches the upper limit temperature T2. That is, the controller 116 controls the water amount proportional valve 126 such that the water discharge temperature detected by the water discharge temperature sensor 122 reaches the upper limit temperature T2. In the example shown in FIG. 16, the temperature of hot water to be discharged from the water discharge device 108 is rapidly reduced after start of water discharge at the time t101, and is reduced to the upper limit temperature T2 at a time t102.

Next, in step S207, whether there is a lapse of a predetermined continuous water discharge time is determined, and in the case where there is no lapse of the continuous water discharge time, step S208 is performed next, and in the case where there is a lapse of the continuous water discharge time, the process in the subroutine shown in FIG. 14 is ended, and the process returns to the flowchart shown in FIG. 13. Furthermore, in step S208, whether a water discharge stop operation is performed by the bathing person is determined, and in the case where the water discharge stop operation is not performed, step S202 is performed again, and in the case where the water discharge stop operation is performed, the process in the subroutine shown in FIG. 14 is ended, and the process returns to the flowchart shown in FIG. 13.

Accordingly, in the example shown in FIG. 16, after the time t102, processes in steps S202→S203→S207→S208→S202 in FIG. 14 are repeatedly performed. Then, at a time t103 in FIG. 16, when the temperature change suppression time elapses, the process in the subroutine shown in FIG. 14 proceeds from step S202 to S204.

In step S204, the controller 116 causes the temperature of hot water to be discharged from the water discharge device 108 to be reduced to lower than the upper limit temperature T2. More specifically, the controller 116 controls the water amount proportional valve 126 based on the water discharge temperature detected by the water discharge temperature sensor 122, and adjusts a flow rate of tap water that is mixed into the circulation channel (the first conduit 104*a*) from the supply channel 141. Furthermore, the controller 116 controls the water amount proportional valve 126 such that the temperature of hot water to be discharged from the water discharge device 108 is gradually reduced.

Next, in step S205, whether the temperature of hot water to be discharged from the water discharge device 108 is at or higher than a predetermined intermediate temperature T4 is determined. In the case where the temperature of hot water is at or higher than the intermediate temperature T4, step S207 is performed next, and in the case where the temperature is lower than the intermediate temperature T4, step S206 is performed next. In the present embodiment, the intermediate temperature T4 is set to a predetermined temperature that is lower than the upper limit temperature T2 and higher than the lower limit temperature T1. In the example shown in FIG. 16, after the time t103, processes in steps S205→S207→S208→S202→S204→S205 in FIG. 14 are repeatedly performed.

Furthermore, when the temperature of hot water is reduced to lower than the intermediate temperature T4 at a time t104 in FIG. 16, the process in the subroutine shown in FIG. 14 proceeds from step S205 to S206. In step S206, the controller 116 ends the temperature adjustment control, and maintains the temperature of hot water to be discharged from the water discharge device 108 at around the intermediate temperature T4. In the example shown in FIG. 16, after the time t104, processes in steps S206→S207→S208→S202→S204→S205→S206 are repeatedly performed in the subroutine in FIG. 14.

As described above, the controller 116 controls the water amount proportional valve 126 in such a way that the temperature of hot water to be discharged from the water discharge device 108 is gradually reduced after being reduced to the upper limit temperature T2 (time t103). Accordingly, a reduction time B2 in a second stage C2 when the temperature of hot water to be discharged from the water discharge device 108 is reduced from the upper limit temperature T2 to the intermediate temperature T4 is longer than a reduction time B1 in a first stage C1 when the temperature of hot water is reduced from the initial temperature T3 to the upper limit temperature T2. As a result, a reduction rate R1 of reduction in the temperature in the first stage C1 is greater than a reduction rate R2 in the second stage C2.

In the example shown in FIG. 16, the predetermined continuous water discharge time elapses at a time t105, and the process by the controller 116 returns to the flowchart in FIG. 13 from the subroutine in FIG. 14 (step S207→return). Furthermore, the process by the controller 116 returns to the flowchart in FIG. 13 also when the water discharge stop operation is performed by the bathing person (step S208→return).

When the process in the subroutine in FIG. 14 is ended and return to the flowchart in FIG. 13 is performed, step S113 in FIG. 13 is performed. In step S113, the controller 116 transmits a control signal to the circulation pump 106 and stops the circulation pump 106, and also, transmits a control signal to the injection valve 140 and closes the injection valve 140. When step S113 is performed, water discharge from the water discharge device 108 is stopped, and the process in the flowchart in FIG. 13 is ended.

In the case where the temperature of hot water in the bathtub main body 102 is at or lower than the upper limit temperature T2 and at or higher than the lower limit temperature T1 at a time point when a water discharge operation is performed by the bathing person (steps S106→S107 in FIG. 13), the processes in steps S107→S109→S111→S112→S107 in the flowchart in FIG. 13 are repeatedly performed. Then, when the predetermined continuous water discharge time elapses (step S111→end), or when the water discharge stop operation is performed by the bathing person (step S112→end), the process in the flowchart in FIG. 13 is ended.

Moreover, in the case where the temperature of hot water in the bathtub main body 102 at a time point when the water discharge operation is performed by the bathing person (steps S106→S107 in FIG. 13) is lower than the lower limit temperature T1 of the predetermined temperature range T, the process in the flowchart in FIG. 13 proceeds in the order of steps S107→S109→S110, and a subroutine shown in FIG. 15 is performed. Furthermore, in the example shown in FIG. 17, filling of hot water is completed at a time t200, and the water discharge start operation is performed by the bathing person at a time t201. At this time, the temperature of hot water in the bathtub main body 102 is lower than the lower limit temperature T1, and thus, the process in the flowchart proceeds to step S110, and second temperature adjustment control for increasing the water discharge temperature to higher than the lower limit temperature T1 is performed by the subroutine shown in FIG. 15.

In step S301 in FIG. 15, water discharge from the water discharge part 108*a* of the water discharge device 108 is started by the controller 116. That is, hot water in the bathtub main body 102 is drawn in from the water intake port part 109*b*, and is discharged from the water discharge part 108*a* through the first conduit 104*a*, the chamber 111, and the second conduit 104*b* as the circulation channel. Furthermore, at the same time, the controller 116 opens the injection valve 140, and causes hot water at a high temperature that is supplied from the supply channel 141 to be mixed in the circulation channel (the first conduit 104*a*). Here, the supply channel 141 is filled with hot water at a higher temperature than the lower limit temperature T1 in step S105 (FIG. 13), and hot water at a high temperature can be mixed in the first conduit 104*a* from the start.

Next, in step S302, whether there is a lapse of a predetermined temperature change suppression time from the start of water discharge at the time t201 is determined. In the case where there is no lapse of the predetermined temperature change suppression time, step S303 is performed next, and in the case where there is a lapse of the temperature change suppression time, step S304 is performed next.

In step S303, temperature adjustment control is performed by the controller 116 such that the temperature of hot water to be discharged from the water discharge device 108 reaches the lower limit temperature T1. That is, the controller 116 controls the water amount proportional valve 126 such that the water discharge temperature detected by the water discharge temperature sensor 122 reaches the lower limit temperature T1. In the example shown in FIG. 17, the temperature of hot water to be discharged from the water discharge device 108 is quickly increased after start of water discharge at the time t201, and reaches the lower limit temperature T1 at a time t202.

Next, in step S307, whether there is a lapse of a predetermined continuous water discharge time is determined, and in the case where there is no lapse of the continuous water discharge time, step S308 is performed next, and in the case where there is a lapse of the continuous water discharge time, the process in the subroutine shown in FIG. 15 is ended, and the process returns to the flowchart shown in FIG. 13. Furthermore, in step S308, whether a water discharge stop operation is performed by the bathing person is determined, and in the case where the water discharge stop operation is not performed, step S302 is performed next, and in the case where the water discharge stop operation is performed, the process in the subroutine shown in FIG. 15 is ended, and the process returns to the flowchart shown in FIG. 13.

Accordingly, in the example shown in FIG. 17, after the time t202, the processes in steps S302→S303→S307→S308→S302 in FIG. 15 are repeatedly performed. Then, at a time t203 in FIG. 17, when the temperature change suppression time elapses, the process in the subroutine shown in FIG. 15 proceeds from step S302 to S304.

In step S304, the controller 116 increases the temperature of hot water to be discharged from the water discharge device 108 to higher than the lower limit temperature T1. More specifically, the controller 116 controls the water amount proportional valve 126 based on the water discharge temperature detected by the water discharge temperature sensor 122, and adjusts a flow rate of hot water at a high temperature that is to be mixed in the circulation channel (the first conduit 104*a*) from the supply channel 141. Furthermore, the controller 116 controls the water amount proportional valve 126 in such a way that the temperature of hot water to be discharged from the water discharge device 108 is gradually increased.

Next, in step S305, whether the temperature of hot water to be discharged from the water discharge device 108 is at or lower than a predetermined intermediate temperature T6 is determined. In the case where the temperature of hot water is at or lower than the intermediate temperature T6, step S307 is performed next, and in the case where the temperature is higher than the intermediate temperature T6, step S306 is performed next. In the present embodiment, the intermediate temperature T6 is set to a predetermined temperature that is lower than the upper limit temperature T2 and higher than the lower limit temperature T1. In the example shown in FIG. 17, after the time t203, the processes in steps S305→S307→S308→S302→S304→S305 in FIG. 15 are repeatedly performed.

Furthermore, when the temperature of hot water exceeds the intermediate temperature T6 at a time t204 in FIG. 17, the process in the subroutine shown in FIG. 15 proceeds from step S305 to S306. In step S306, the controller 116 ends the temperature adjustment control, and maintains the temperature of hot water to be discharged from the water discharge device 108 to around the intermediate temperature T6. In the example shown in FIG. 17, after the time t204, processes in steps S306→S307→S308→S302→S304→S305→S306 are repeatedly performed in the subroutine in FIG. 15.

As described above, the controller 116 controls the water amount proportional valve 126 such that the temperature of hot water to be discharged from the water discharge device 108 is gradually increased after being increased to the lower limit temperature T1 (time t203). Accordingly, an increase time B12 in a second stage C12 when the temperature of hot water to be discharged from the water discharge device 108 is increased from the lower limit temperature T1 to the intermediate temperature T6 is longer than an increase time B11 in a first stage C11 when the temperature of hot water is increased from the initial temperature T5 to the lower limit temperature T1. As a result, an increase rate R11 of increase in the temperature in the first stage C11 is greater than an increase rate R12 in the second stage C12.

In the example shown in FIG. 17, the predetermined continuous water discharge time elapses at a time t205, and the process by the controller 116 returns from the subroutine in FIG. 15 to the flowchart in FIG. 13 (step S307→return). Furthermore, the process by the controller 116 also returns to the flowchart in FIG. 13 when the water discharge stop operation is performed by the bathing person (step S308→return).

When the process in the subroutine in FIG. 15 is ended and return to the flowchart in FIG. 13 is performed, step S113 in FIG. 13 is performed. In step S113, the controller 116 transmits a control signal to the circulation pump 106 and stops the circulation pump 106, and also, transmits a control signal to the injection valve 140 and closes the injection valve 140. Water discharge from the water discharge device 108 is stopped by execution of step S113, and the process in the flowchart in FIG. 13 is ended.

With the bathtub device 101 of the second embodiment of the present invention, the temperature of hot water in the bathtub main body 102 is acquired in a state where water discharge from the water discharge part 108*a* is not performed (step S101 in FIG. 13), and in the case where the temperature is higher than the upper limit temperature T2, hot water (tap water) at a lower temperature than the upper limit temperature T2 is caused to flow into the supply channel 141 (step S103 in FIG. 13). Accordingly, when an instruction signal to start water discharge is received by the controller 116, hot water, in the supply channel 141, at a lower temperature than the upper limit temperature T2 can be immediately mixed with hot water that is to be discharged from the water discharge part 108*a* (step S203 in FIG. 14), and the temperature of hot water to be discharged from the water discharge part 108*a* can be quickly reduced (time t101 to t102 in FIG. 16).

As described above, with the bathtub device 101 according to the second embodiment of the present invention, the temperature of hot water to be discharged from the water discharge part 108*a* is reduced from immediately after start of water discharge. In a modification of the second embodiment, the temperature of hot water to be discharged may be reduced from immediately after start of water discharge by using the configuration (FIG. 6) of the bathtub device 1 according to the first embodiment of the present invention.

In this case, the controller 16 acquires the temperature of hot water in the bathtub main body 2 by the bathtub water temperature sensor 123 in a state where water discharge from the water discharge device 8 is not performed, and causes hot water (tap water) at a lower temperature than the upper limit temperature T2 to be stored in the reservoir part 12 in a case where the acquired temperature is higher than the upper limit temperature T2. When an instruction signal to start water discharge from the water discharge device 8 is received, the controller 16 performs the water discharge temperature adjustment mode by mixing hot water stored in the reservoir part 12 with hot water that is to be discharged from the water discharge device 8.

That is, in the case where the temperature of hot water in the bathtub main body 2 is higher than the upper limit temperature T2, the controller 16 opens the low temperature side electromagnetic valve 58, and fills the reservoir part 12 with tap water supplied from the waterworks 54 (hot water stored in the reservoir part 12 is caused to overflow from the overflow pipe 44 due to introduction of tap water, and the temperature of hot water in the reservoir part 12 is reduced). Next, when an instruction signal to start water discharge from the water discharge device 8 is received, the controller 16 opens the electromagnetic valve 40, and activates the second pump 14. Accordingly, hot water (tap water) at a low temperature in the reservoir part 12 is mixed with hot water that is to be discharged from the water discharge device 8 via the chamber 11.

In the present modification configured in the above manner, the temperature of hot water in the bathtub main body 2 is acquired in a state where water discharge from the water discharge device 8 is not performed, and in a case where the temperature is higher than the upper limit temperature T2, hot water at a lower temperature than the upper limit temperature T2 is stored in the reservoir part 12. Accordingly, when the controller 16 receives an instruction signal to start water discharge, hot water, in the reservoir part 12, at a lower temperature than the upper limit temperature T2 can immediately be mixed in hot water that is to be discharged from the water discharge device 8, and the temperature of hot water to be discharged from the water discharge device 8 can be quickly reduced.

With the bathtub device 101 of the second embodiment of the present invention, the temperature of hot water in the bathtub main body 102 is acquired in a state where water discharge from the water discharge part 108*a* is not performed (step S101 in FIG. 13), and in a case where the temperature is higher than the lower limit temperature T1, hot water at a higher temperature than the lower limit temperature T1 is caused to flow into the supply channel 141 (step S105 in FIG. 13). Accordingly, when an instruction signal to start water discharge is received by the controller 116, hot water, in the supply channel 141, at a higher temperature than the lower limit temperature T1 can be immediately mixed with hot water that is to be discharged from the water discharge part 108*a* (step S303 in FIG. 15), and the temperature of hot water to be discharged from the water discharge part 108*a* can be quickly increased (time t201 to t202 in FIG. 17).

As described above, with the bathtub device 101 according to the second embodiment of the present invention, the temperature of hot water to be discharged from the water discharge part 108*a* is increased from immediately after start of water discharge. In a modification of the second embodiment, the temperature of hot water to be discharged may be increased from immediately after start of water discharge by using the configuration (FIG. 6) of the bathtub device 1 according to the first embodiment of the present invention.

In this case, the controller 16 acquires the temperature of hot water in the bathtub main body 2 by the bathtub water temperature sensor 123 in a state where water discharge from the water discharge device 8 is not performed, and in a case where the acquired temperature is lower than the lower limit temperature T1, hot water at a higher temperature than the lower limit temperature T1 is stored in the reservoir part 12. When an instruction signal to start water discharge from the water discharge device 8 is received, the controller 16 performs the water discharge temperature adjustment mode by causing hot water stored in the reservoir part 12 to be mixed in hot water that is to be discharged from the water discharge device 8.

That is, in the case where the temperature of hot water in the bathtub main body 2 is lower than the lower limit temperature T1, the controller 16 opens the high temperature side electromagnetic valve 56, and fills the reservoir part 12 with hot water at a high temperature that is supplied from the water heater 52 (hot water stored in the reservoir part 12 is caused to overflow from the overflow pipe 44 due to introduction of hot water at a high temperature, and the temperature of hot water in the reservoir part 12 is increased). Next, when an instruction signal to start water discharge from the water discharge device 8 is received, the controller 16 opens the electromagnetic valve 40, and activates the second pump 14. Accordingly, hot water at a high temperature in the reservoir part 12 is mixed with hot water that is to be discharged from the water discharge device 8 via the chamber 11.

In the present modification configured in the above manner, the temperature of hot water in the bathtub main body 2 is acquired in a state where water discharge from the water discharge device 8 is not performed, and in a case where the temperature is lower than the lower limit temperature T1, hot water at a higher temperature than the lower limit temperature T1 is stored in the reservoir part 12. Accordingly, when the controller 16 receives an instruction signal to start water discharge, hot water, in the reservoir part 12, at a higher temperature than the lower limit temperature T1 can immediately be mixed in hot water that is to be discharged from the water discharge device 8, and the temperature of hot water to be discharged from the water discharge device 8 can be quickly increased.

REFERENCE SIGNS LIST

1: bathtub device
2: bathtub main body
4: circulation channel
6: first pump
9: water intake port part
9*b*: water intake port part (bathtub water intake port)
10: water supply channel (supply conduit)
11: chamber
11*a*: negative pressure generation part
12: reservoir part (reservoir tank)
14: second pump (pressure pump)
16: controller
101: bathtub device
102: bathtub main body
104*a*: first conduit (circulation channel)
104*b*: second conduit (circulation channel)
106: circulation pump
107: temperature modification part
108: water discharge device
108*a*: water discharge part
109*a*: bathtub water discharge port
109*b*: water intake port part
111: chamber
112: vacuum breaker
116: controller
122: water discharge temperature sensor
123: bathtub water temperature sensor (sensing unit)
124: water amount sensor
126: water amount proportional valve
130: inflow side thermistor
136: water discharge electromagnetic valve

138: check valve
140: injection valve
141: supply channel
142: discharge passage
147: check valve
152: water heater
154: waterworks
154*a*: branching portion
156: high temperature side electromagnetic valve
158: low temperature side electromagnetic valve

The invention claimed is:

1. A bathtub device for discharging hot water into a bathtub, the bathtub device comprising:

a bathtub main body for storing hot water;

a water intake port part for drawing in hot water in the bathtub main body;

a water discharge part provided on the bathtub main body and discharging hot water drawn in from the water intake port part into the bathtub main body;

a circulation channel connecting the water intake port part to the water discharge part;

a circulation pump provided on the circulation channel and feeding hot water drawn in from the water intake port part through the circulation channel;

a temperature modification part for modifying a temperature of hot water discharged from the water discharge part;

a sensing unit for detecting a temperature of hot water in the bathtub main body; and a controller for controlling the temperature of hot water discharged from the water discharge part by using the temperature modification part and configured to freely set an upper limit temperature and a lower limit temperature of a predetermined temperature range by a user, wherein the controller performs;

a water discharge temperature adjustment mode in which the temperature of hot water discharged from the water discharge part is reduced to within the predetermined temperature range by controlling the temperature modification part, when the temperature of hot water detected by the sensing unit is higher than the upper limit temperature of the predetermined temperature range, and a water discharge temperature adjustment mode in which the temperature of hot water discharged from the water discharge part is increased to within the predetermined temperature range by controlling the temperature modification part, when the temperature of hot water detected by the sensing unit is lower than the lower limit temperature of the predetermined temperature range, thereby the temperature of hot water discharged from the water discharge part is maintained within the predetermined temperature range.

2. The bathtub device according to claim 1, wherein, in the water discharge temperature adjustment mode, the controller circulates hot water drawn in from the water intake port part to discharge hot water from the water discharge part, for a predetermined period of time from start of water discharge and after a lapse of the predetermined period of time, the controller reduces the temperature of hot water discharged from the water discharge part to within the predetermined temperature range by controlling the temperature modification part, or the controller increases the temperature of hot water discharged from the water discharge part to within the predetermined temperature range by controlling the temperature modification part.

3. The bathtub device according to claim 1, wherein the temperature modification part includes a reservoir part for storing hot water at a desired temperature, the controller acquires the temperature of hot water in the bathtub main body by the sensing unit in a state where hot water is not discharged by the water discharge part, and causes hot water at a lower temperature than the upper limit temperature to be stored in the reservoir part when the acquired temperature is higher than the upper limit temperature, or causes hot water at a higher temperature than the lower limit temperature to be stored in the reservoir part when the acquired temperature is lower than the lower limit temperature, and wherein the controller conducts the water discharge temperature adjustment mode by mixing hot water stored in the reservoir part with hot water discharged from the water discharge part, when an instruction signal for starting water discharge is received.

4. The bathtub device according to claim 1, wherein the temperature modification part includes a supply channel for mixing hot water at a desired temperature in the circulation channel, the controller acquires the temperature of hot water in the bathtub main body by the sensing unit in a state where hot water is not discharged by the water discharge part, and causes hot water at a lower temperature than the upper limit temperature to flow into the supply channel when the acquired temperature is higher than the upper limit temperature, and causes hot water at a higher temperature than the lower limit temperature to flow into the supply channel when the acquired temperature is lower than the lower limit temperature, and wherein the controller conducts the water discharge temperature adjustment mode by mixing hot water inside the supply channel with hot water discharged from the water discharge part, when an instruction signal for starting water discharge is received.

5. The bathtub device according to claim 1, wherein, in the water discharge temperature adjustment mode, the controller reduces or increases the temperature of hot water discharged from the water discharge part, by controlling the temperature modification part, over a plurality of stages from the temperature of hot water in the bathtub main body to a temperature within the predetermined temperature range.

6. The bathtub device according to claim 5, wherein, in the water discharge temperature adjustment mode, the controller reduces the temperature of hot water discharged from the water discharge part in such a way that a reduction rate of reduction in the temperature of hot water in a first stage among the plurality of stages is greater than the reduction rate in a second stage, or the controller increases the temperature of hot water discharged from the water discharge part in such a way that an increase rate of increase in the temperature of hot water in the first stage among the plurality of stages is greater than the increase rate in the second stage.

7. The bathtub device according to claim 5, wherein, in the water discharge temperature adjustment mode, the controller reduces the temperature of hot water discharged from the water discharge part in such a way that a reduction time of reduction in the temperature of hot water in a first stage among the plurality of stages is shorter than the reduction time in a second stage, or the controller increases the temperature of hot water discharged from the water discharge part in such a way that an increase time of increase in the temperature of hot water in the first stage among the plurality of stages is shorter than the increase time in the second stage.

8. The bathtub device according to claim 6, wherein the water discharge temperature adjustment mode includes temperature change suppression control conducted between the first stage and the second stage, in which a reduction in the temperature is smaller than in either of the first stage and the second stage, or the temperature change suppression control conducted between the first stage and the second stage, in which an increase in the temperature is smaller than in either of the first stage and the second stage.

9. The bathtub device according to claim 8, wherein, in the water discharge temperature adjustment mode, an execution time of the temperature change suppression control is longer than an execution time of the first stage.

10. The bathtub device according to claim 8, wherein, in the water discharge temperature adjustment mode, an execution time of the temperature change suppression control is shorter than an execution time of the second stage.

11. The bathtub device according to claim 1, wherein the temperature modification part includes a water supply channel connected to the circulation channel and the water supply channel supplies hot water or water from an external supply source.

* * * * *